US008047529B2

(12) United States Patent
Fukasawa

(10) Patent No.: US 8,047,529 B2
(45) Date of Patent: Nov. 1, 2011

(54) METHOD OF FEEDING MEDIUM IN RECORDING APPARATUS, AND RECORDING APPARATUS

(75) Inventor: Jun Fukasawa, Hata-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/342,235

(22) Filed: Dec. 23, 2008

(65) Prior Publication Data

US 2009/0166963 A1 Jul. 2, 2009

(30) Foreign Application Priority Data

Dec. 26, 2007 (JP) ..... 2007-334873

(51) Int. Cl.
*B65H 5/00* (2006.01)

(52) U.S. Cl. ..... 271/10.03; 271/265.02

(58) Field of Classification Search ..... 271/4.02, 271/4.03, 10.02, 10.03, 110, 265.01, 265.02
See application file for complete search history.

(56) References Cited

U.S. PATENT DOCUMENTS

| | | | | |
|---|---|---|---|---|
| 5,423,527 | A * | 6/1995 | Tranquilla | 271/10.02 |
| 6,076,821 | A * | 6/2000 | Embry et al. | 271/10.01 |
| 6,439,563 | B1 * | 8/2002 | Kayani | 271/10.03 |
| 6,595,510 | B2 * | 7/2003 | Kayani | 271/10.03 |
| 6,923,437 | B2 * | 8/2005 | Huang et al. | 271/4.03 |
| 7,068,969 | B2 * | 6/2006 | Ueda | 399/388 |
| 7,178,914 | B2 * | 2/2007 | Marra et al. | 347/104 |
| 7,275,740 | B2 * | 10/2007 | Able et al. | 271/10.01 |
| 7,396,009 | B2 * | 7/2008 | Elliott et al. | 271/10.03 |
| 7,497,430 | B2 * | 3/2009 | Kusumi | 271/10.03 |
| 7,651,090 | B2 * | 1/2010 | Satoh et al. | 271/265.02 |
| 2001/0022422 | A1 * | 9/2001 | Tamura | 271/10.03 |
| 2004/0119224 | A1 * | 6/2004 | Otsuka | 271/10.03 |

FOREIGN PATENT DOCUMENTS

| | | |
|---|---|---|
| JP | 03-095043 | 4/1991 |
| JP | 2001-278472 | 10/2001 |
| JP | 2002-145469 | 5/2002 |
| JP | 2002-283637 | 10/2002 |
| JP | 2003-072964 | 3/2003 |
| JP | 2005-022792 | 1/2005 |
| JP | 2008-056418 | 3/2008 |
| JP | 2008-056444 | 3/2008 |
| JP | 2008-087203 | 4/2008 |

* cited by examiner

*Primary Examiner* — Kaitlin Joerger
(74) *Attorney, Agent, or Firm* — Maschoff Gilmore & Israelsen

(57) ABSTRACT

A recording apparatus including feeding unit that feeds a medium, conveying unit that conveys the fed medium, recording unit that performs recording on the medium, and controlling unit that controls the feeding unit and the conveying unit, a measuring unit that measures a distance between the previous medium and the next medium after completing the preparatory feeding; and determining unit that determines whether or not the measured distance is a predetermined distance or greater, wherein, if the distance is the predetermined distance or greater, the controlling unit completely feeds the next medium.

5 Claims, 11 Drawing Sheets

METHOD OF FEEDING MEDIUM IN RECORDING APPARATUS, AND RECORDING APPARATUS

BACKGROUND

1. Technical Field

The present invention relates to a method of feeding a medium in a recording apparatus, which starts to feed a subsequent medium while recording is being performed on a previous medium being fed, and to a recording apparatus.

2. Related Art

A printer, which is a known example of recording apparatuses includes an auto sheet feeder (hereinafter, referred to as ASF) (for example, JP-A-2003-72964 or the like). When printing starts, the ASF is driven to feed an uppermost sheet from among sheets stacked in a cassette, and a leading end of the sheet is positioned at a printing start position.

The ASF starts to feed a subsequent sheet after a previous sheet has been printed and discharged. In the feeding method which starts to feed the subsequent sheet after the previous sheet has been printed, however, a relatively long standby time is present between the start of discharge of the previous sheet and the start of printing of the subsequent sheet. Accordingly, printing throughput is deteriorated.

In order to solve this problem, JP-A-2003-72964 discloses a recording apparatus that simultaneously performs a discharge operation of a previous sheet and a feeding operation of a subsequent sheet while maintaining a predetermined gap between the previous sheet and the subsequent sheet. That is, in the recording apparatus of JP-A-2003-72964, the position of a trailing end of the previous sheet is calculated on the basis of a transport distance of the previous sheet and sheet length data. Then, if two conditions that the trailing end of the previous sheet has passed through a specified position and a discharge command has been received are satisfied, the feeding operation of the subsequent sheet starts. According to this recording apparatus, the discharge operation of the previous sheet and the feeding operation of the subsequent sheet are simultaneously performed, while an inter-paper distance between the previous sheet and the subsequent sheet is ensured. Therefore, a standby time from the start of discharge of the previous sheet and the start of printing of the subsequent sheet can be shortened, and as a result printing throughput can be improved.

JP-A-2005-22792 (paragraphs [0029] to [0054]) discloses a sheet feeding device in which a leading end of a subsequent sheet is positioned in front of a feed/separation roller beforehand. In this case, before an instruction to control a feeding operation of the subsequent sheet is input, a pickup roller is driven to start a preliminary feeding operation. Then, if a pre-separation sensor detects a leading end of the subsequent sheet fed by the preliminary feeding operation, the pickup roller is stopped. In this sheet feeding device, if a post-separation sensor detects that the previous sheet has passed through the feed/separation roller, a control device starts to drive the pickup roller and the feed/separation roller.

JP-A-2001-278472 and JP-A-2002-145469 disclose a page printer in which, in order to improve throughput, a feeding operation of a next page starts before recording on a previous page is completed (so-called preceding feeding).

According to the recording apparatus of JP-A-2003-72964, if recording is performed to the end of the previous sheet (recordable last row), the discharge command may be received a long time after transporting of the previous sheet was started. For this reason, a gap between the previous sheet and the subsequent sheet exists, and printing throughput is deteriorated.

In the recording apparatus of JP-A-2005-22792, after the subsequent sheet is preliminary fed, the feeding operation of the subsequent sheet starts when the post-separation sensor detects the passage of the previous sheet. The gap between the previous sheet and the subsequent sheet is defined by a gap between the pre-separation sensor and the post-separation sensor. The inter-sensor gap is not necessarily identical to a gap which should be ensured between the previous sheet and the subsequent sheet. For this reason, at some positions of the sensors in the recording apparatus, when the feeding operation of the subsequent sheet starts on the basis of the instruction to control the feeding operation, a necessary gap between the previous sheet and the subsequent sheet may not be ensured. As described in the JP-A-2003-72964, an insufficient inter-paper gap results in a paper detection sensor not being able to detect the leading end of the subsequent sheet, and accordingly, it is difficult to manage the transport position of the subsequent sheet.

SUMMARY

An advantage of some aspects of the invention is that it provides a method of feeding a medium in a recording apparatus, which is capable of preventing a delay of start of a transport operation while maintaining a gap between a previous medium and a subsequent medium, thereby preventing throughput from being deteriorated, and a recording apparatus.

According to an aspect of the invention, a recording apparatus includes: a recording unit that performs recording onto a medium; a feeding unit that feeds the medium; a transport unit that transports the fed medium, in such a manner as to alternate with recording of the recording unit; a preliminary feeding unit that preliminarily feeds a subsequent medium such that a leading end of the subsequent medium becomes close to a trailing end of a previous medium being recorded; a determination value acquiring unit that, after the preliminary feeding operation starts and before a transport operation of the previous medium starts, when the previous medium and the subsequent medium are stopped, acquires a determination value according to a gap between the previous medium and the subsequent medium; and a control unit that performs the transport operation of the previous medium. If the determination value represents an appropriate gap between the previous medium and the subsequent medium, the control unit feeds the subsequent medium while the transport operation of the previous medium is being performed. If the determination value represents an inappropriate gap, the control unit feeds no subsequent medium while the transport operation of the previous medium is being performed. When it comes a time to acquire the determination value, if the preliminary feeding operation is still continuing, the control unit acquires no determination value and starts the transport operation of the previous medium. Herein, the recording operation includes an operation of the recording unit to perform recording onto the medium and an operation to transport the medium. Moreover, "alternation of recording and transport" is a concept including a case in which the recording operation of the recording unit and the transport operation of the medium are alternately performed, and a case in which the recording operation and the transport operation are substantially alternately performed but partially temporally overlap each other.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment in which the invention is embodied will be described with reference to FIGS. 1 to 11.

Figure 1:
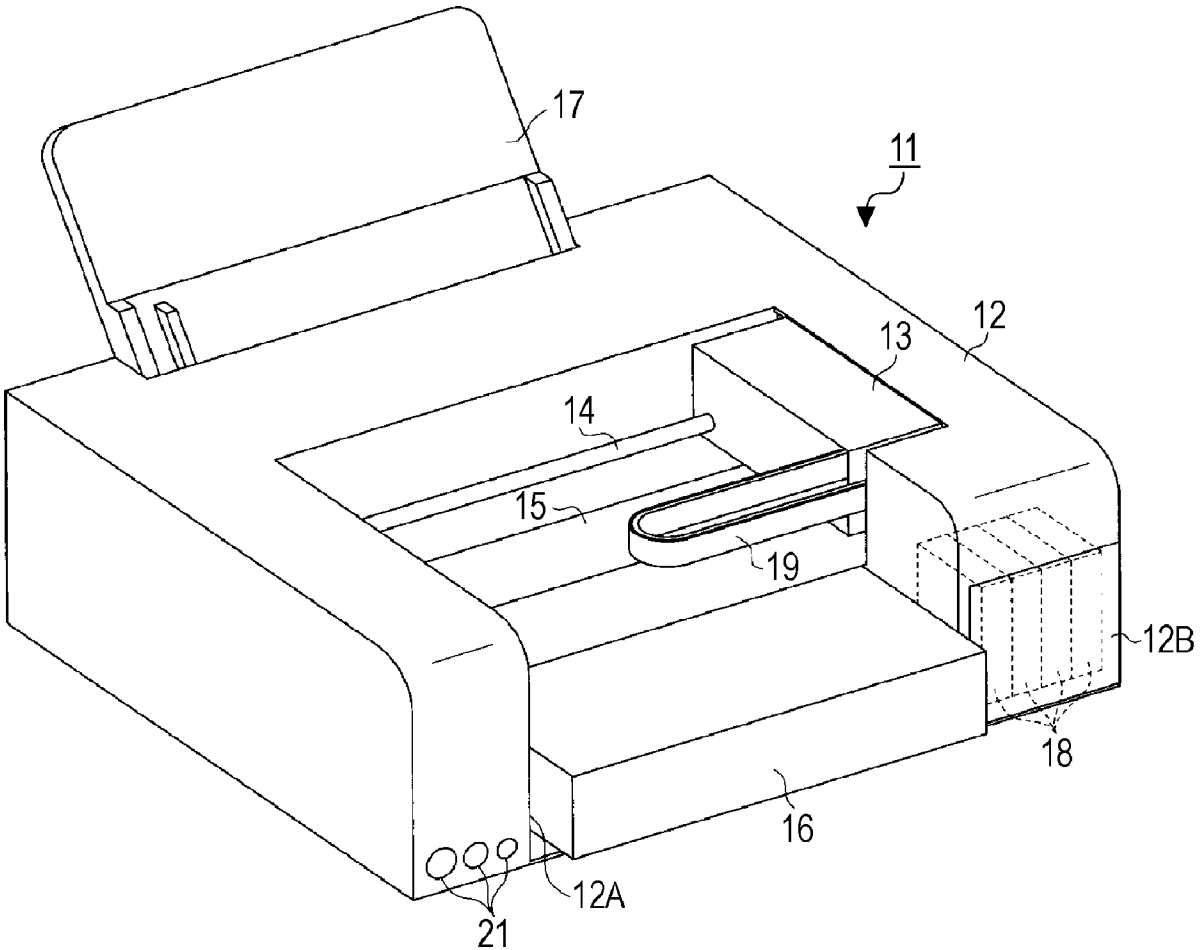
FIG. 1 is a perspective view of a printer according to an embodiment of the invention.

FIG. 1 is a perspective view of a printer according to this embodiment. As shown in FIG. 1, a printer 11 which is an example of recording apparatuses has a rectangular boxlike main body 12. A carriage 13 is provided in a central portion of the main body 12 so as to freely reciprocate in a main scanning direction (left-right direction in FIG. 1) along a guide shaft 14.

As shown in FIG. 1, a long plate-shaped platen 15 is disposed at a lower position opposing the carriage 13 in the main body 12. In a lower portion on a front surface of the printer 11 (a surface on a near side in FIG. 1), a sheet feeding cassette 16 is detachably mounted in a concave mounting portion 12A. A sheet feeding tray 17 is provided in an upper portion on a rear surface of the main body 12. In this embodiment, the printer selectively performs a feeding operation from the sheet feeding cassette 16 in the front portion thereof and a feeding operation from the sheet feeding tray 17 in the rear portion thereof.

A plurality of ink cartridges 18 are loaded in a cover 12B which covers a front right surface of the main body 12. Ink in the ink cartridges 18 is supplied to the carriage 13 through a plurality of ink supply tubes (not shown) which are provided in a flexible wiring board 19, and ink droplets are ejected (discharged) from a recording head 20 (shown in FIG. 2) which is provided below the carriage 13. In the recording head 20, a pressurization element (piezoelectric element, electrostatic element, or heater element) for applying an ejection pressure to ink is incorporated in each nozzle. If a predetermined voltage is applied to the pressurization element, ink droplets are ejected (discharged) from the corresponding nozzle.

During printing, ink droplets are ejected from the recording head 20 onto a sheet fed from the sheet feeding cassette 16 and positioned on the platen 15 while the carriage 13 is reciprocating, and thus printing for one line is performed. After printing for one line is completed, the sheet is transported to a printing position of a next row. In this way, a printing operation achieved by one scanning operation of the carriage 13 and a paper transport operation to transport the sheet to the printing position of the next row are alternately performed, thereby performing printing on the sheet. Various operating switches 21 including a power switch are provided in a lower portion on a front left surface of the main body 12. The printing operation and the paper transport operation may be temporally independently performed. In this embodiment, the printing operation and the paper transport operation are performed such that the other operation starts before one operation is completed, and the operations partially overlap each other at the start and end of the operations.

Figure 2:
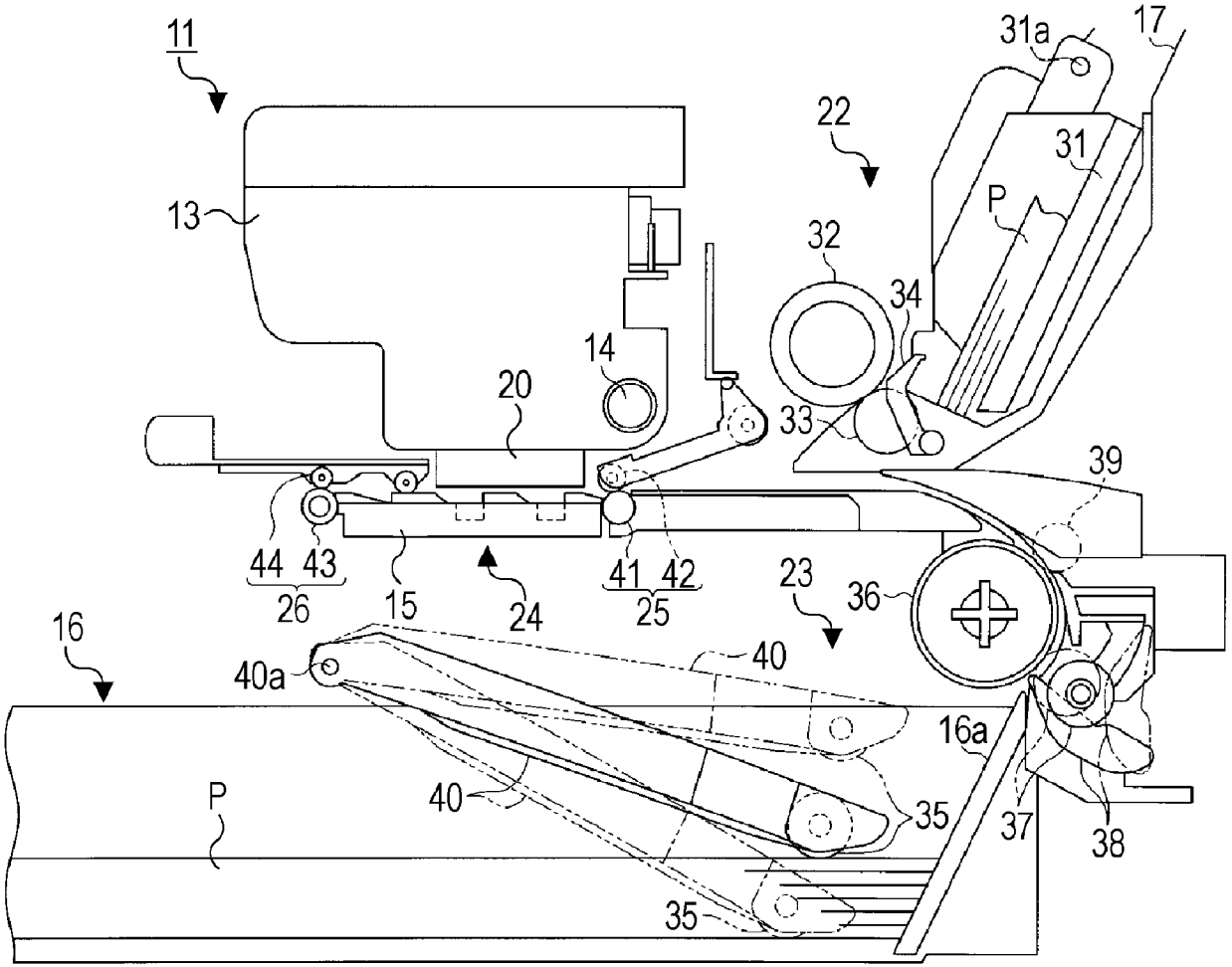
FIG. 2 is a schematic side sectional view showing an auto sheet feeder and a paper transport mechanism.

FIG. 2 is a side view showing the overall configuration of the printer. Hereinafter, the overall configuration of the printer 11 will be described in detail with reference to FIG. 2. The printer 11 includes a rear feeder 22 in the rear portion thereof and a front feeder 23 in the bottom portion thereof. A sheet P (mainly, single sheet) serving as a recording medium is fed from one of the two feeders 22 and 23 to a pair of transport rollers 25. The sheet P is transported to a recording section 24 by the pair of transport rollers 25, and after recording is performed, is discharged to a stacker (not shown) by a pair of discharge rollers 26.

Hereinafter, the components on a paper transport path will be further described in detail.

The rear feeder 22 includes a hopper 31, a feed roller 32, a retard roller 33, and a sheet returning lever 34. The hopper 31 pivots around a pivot fulcrum 31*a* in an upper portion thereof, and is switched between a posture in which the sheet P obliquely supported by the hopper 31 is pressed against the feed roller 32, and a posture in which the sheet P is positioned away from the feed roller 32.

The retard roller 33 is provided to have predetermined rotation resistance, and forms a nip point with the feed roller 32 to separate an uppermost sheet P to be fed from a next sheet P. The sheet returning lever 34 is rotatably provided, when a sheet feeding path is viewed in side view. The next sheet P separated by the retard roller 33 is returned to an upstream side by the rotation of the sheet returning lever 34.

The front feeder 23, which is provided in the bottom of the printer 11 and in which the sheet is set from the front side of the printer 11, includes the sheet feeding cassette 16, a pickup roller 35, an intermediate roller 36, a retard roller 37 serving as a separation unit, a sheet returning lever 38, and an assist roller 39.

A plurality of sheets P (a maximum number of sheets ranging from 300 to 800) are stacked in the sheet feeding cassette 16 which is mounted on and removed from the front side, and the sheets P are delivered from the sheet feeding cassette 16 by the pickup roller 35, which is driven by an ASF motor 54 (see FIG. 4), one by one starting from the uppermost one. The pickup roller 35 is provided in a pivot member 40 which pivots around a pivot shaft 40*a*. When the pivot member 40 pivots while being urged toward the sheet by an urging unit (not shown), the pickup roller 35 is in constant contact with the uppermost sheet. The height of the pickup roller 35 in contact with the uppermost sheet from among the sheets stacked in the sheet feeding cassette 16 changes depending on a residual sheet amount, and accordingly the pivot member 40 pivots around the pivot shaft 40*a* between a highest position when a maximum number of sheets are loaded and a lowest position when a minimum number of sheets are loaded, as indicated by two-dot-chain lines in FIG. 2. As described above, in this embodiment, if a relatively large number of sheets are loaded in the sheet feeding cassette 16, a paper feeding distance is different by a distance corresponding the thickness of a maximum number of sheets between when a sheet is fed at a position where the pickup roller 35 is in contact with the top surface of the uppermost sheet from among the maximum number of sheets and when a sheet is fed at a position where the pickup roller 35 is in contact with the top surface of a last sheet in the sheet feeding cassette 16.

The sheet P which is delivered by the pickup roller 35 constituting a feed unit is preliminarily separated by a separation inclined surface 16*a*, and travels toward the retard roller 37. The retard roller 37 is provided at a position opposing a peripheral surface of the intermediate roller 36 so as to advance and retreat with respect to the intermediate roller 36. When the sheet is delivered from the sheet feeding cassette 16, the retard roller 37 is pressed against the intermediate roller 36 so as to form the nip point, such that the uppermost sheet P (previous page) to be fed and a next sheet P are separated from each other.

The sheet returning lever 38 is rotatably provided, when the paper feeding path is viewed in side view, such that when the sheet returning lever 38 rotates, the nip point of the intermediate roller 36 and the retard roller 37 falls within the trace of a leading end of the lever. At a feeding standby position, the sheet returning lever 38 takes a posture in which the leading end thereof protrudes toward the feeding path, as indicated by a solid line in FIG. 2. When the sheet P is fed, the sheet returning lever 38 rotates to a position indicated by a two-dot-chain line in a clockwise direction in FIG. 2, and retreats from the paper feeding path to open the paper feeding path. When a predetermined time (or predetermined distance) elapses after the paper feeding operation starts, the sheet returning lever 38 rotates to a position indicated by the solid line in a counterclockwise direction of FIG. 2, that is, rotates in a direction to close the paper feeding path. Accordingly, the leading end of the next sheet at the nip point between the retard roller 37 and the intermediate roller 36 is returned to the upstream side (the sheet feeding cassette 16).

The intermediate roller 36 which constitutes a transport unit for further delivering the sheet P fed by the pickup roller 35 to the downstream side, together with the pair of transport rollers 25, is driven by a PF motor 53 (shown in FIG. 4), flexes and inverts the sheet to be fed, and delivers the sheet P to the pair of transport rollers 25 on the downstream side. The assist roller 39 is in contact with the intermediate roller 36 to assist the transport of the sheet P to the downstream side by the intermediate roller 36.

The pair of transport rollers 25 includes a transport driving roller 41 that is rotated by the PF motor 53 (FIG. 4), and a transport driven roller 42 that is rotated while being pressed against the transport driving roller 41 when the transport driven roller 42 rotates. The sheet P whose leading end has reached the pair of transport rollers 25 is transported to the recording section 24 on the downstream side by the rotation of the transport driving roller 41 while being nipped by the transport driving roller 41 and the transport driven roller 42.

The recording section 24 includes a recording head 20 that ejects ink onto the sheet P, and a platen 15 that supports the sheet P to restrict a distance between the sheet P and the recording head 20. The recording head 20 is provided in a bottom portion of the carriage 13. The carriage 13 is driven to reciprocate in a main scanning direction by a carriage motor 52 (see FIG. 4) while being guided by a guide shaft 14 extending in the main scanning direction (a direction perpendicular to the paper plane of FIG. 2). In this example, a so-called off-carriage type in which the ink cartridges 18 are provided in the main body 12 is used, but a so-called on-carriage type in which the ink cartridges are mounted on the carriage may be used.

A pair of discharge rollers 26 provided on the downstream side of the recording section 24 includes a discharge driving roller 43 that is rotated by the PF motor 53 (FIG. 4), and a discharge driven roller 44 that is in contact with the discharge driving roller 43 and is rotated when the discharge driving roller 43 rotates. The sheet P on which recording was performed by the recording section 24 is discharged to a stacker (not shown) provided on the front side of the printer 11 by the rotation of the discharge driving roller 43 while being nipped by the discharge driving roller 43 and the discharge driven roller 44.

Figure 3:
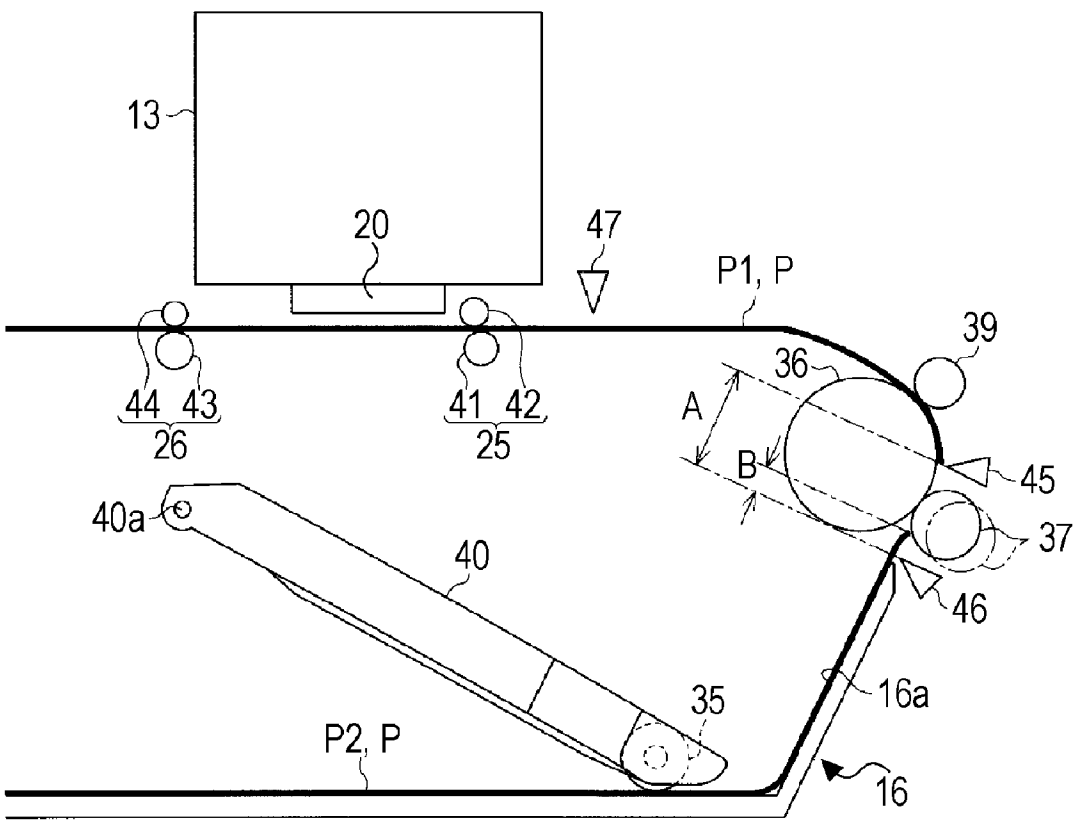
FIG. 3 is a schematic side view of a feeder for explaining constants to be used to calculate an inter-paper distance.

FIG. 3 is a schematic view of an auto paper feeder (front feeder) and a transport device as viewed from a side surface. In the printer 11 of this embodiment, inter-page control processing is performed in which, while a gap between a previous sheet P1 serving as a previous medium and a subsequent sheet P2 serving as a subsequent medium is maintained small, a feeding operation of the subsequent sheet P2 is performed during performance of a recording operation on the previous sheet P1. Hereinafter, various positions and distances to be defined in the inter-page control processing will be described with reference to FIG. 3. The previous sheet P1 indicates a first sheet from among two sheets P to be successively fed during multi-sheet printing, and the subsequent sheet P2 indicates a second sheet to be fed subsequent to the previous sheet P1.

In a paper transport path with the nip point interposed between the intermediate roller 36 and the retard roller 37, a trailing end sensor 45 is provided at a position on a downstream side to detect a trailing end of the previous sheet P1, and a leading end sensor 46 is provided at a position on an upstream side to detect a leading end of the subsequent sheet P2. The distance between the trailing end sensor 45 and the leading end sensor 46 in the transport path is set to A (mm) (for example, a value ranging from 10 to 30 mm).

A paper detection sensor 47 is provided at a predetermined position between the assist roller 39 and the pair of transport rollers 25 in the paper transport path. The paper detection sensor 47 is positioned opposing the transport path of the sheet P to be fed from the rear feeder 22 (see FIG. 2) or the front feeder 23, and detects the leading end and the trailing end of the sheet P. In this embodiment, the trailing end sensor 45, the leading end sensor 46, and the paper detection sensor 47 are formed of non-contact sensors, such as optical sensors. An optical sensor includes a pair of a photoreceiver and a phototransmitter. When light emitted from the phototransmitter is shielded by the sheet P and not received by the photoreceiver, a state "paper present" is detected, and when light is not shielded by the sheet P and is received by the photoreceiver, a state "paper absent" is detected. The sensors 45 to 47 are not limited to non-contact sensors, but at least one of them may be changed to a contact sensor.

The trailing end sensor 45 detects the trailing end of the sheet P (the previous sheet P1) when a detection state is switched from "paper present" to "paper absent". The leading end sensor 46 detects the leading end of the sheet P (the subsequent sheet P2) when a detection state is switched from "paper absent" to "paper present". The paper detection sensor 47 detects the leading end of the sheet P (the previous sheet P1) when a detection state is switched from "paper absent" to "paper present", and detects the trailing end of the sheet P (the previous sheet P1) when the detection state is switched from "paper present" to "paper absent".

In the printer 11 of this embodiment, a plurality of printing modes are set. Of these, in a fast printing mode (a draft printing mode), paper feed control is used in which, if the previous sheet P1 has been transported to a prescribed position, a feeding operation of the subsequent sheet P2 starts even though printing is being performed on the previous sheet P1. That is, if the trailing end of the previous sheet P1 is detected by the trailing end sensor 45, the pickup roller 35 is driven to start the feeding operation of the subsequent sheet P2. Then, the subsequent sheet P2 is stopped at a position a prescribed distance B (mm) (for example, a value ranging 0 to 10 mm) more advanced from a position at which the leading end is detected by the leading end sensor 46. The prescribed distance B (mm) is set such that the leading end of the subsequent sheet P2 is not nipped between the intermediate roller 36 and the retard roller 37. When the trailing end of the previous sheet P1 is detected by the trailing end sensor 45, and a preliminary feeding operation of the subsequent sheet P2 starts, the retard roller 37 is in contact with the intermediate roller 36, and the sheet returning lever 38 rotates from a closed position indicated by the solid line in FIG. 2 to an open position indicated by the two-dot-chain line.

In this embodiment, an inter-paper distance Lg between the previous sheet P1 and the subsequent sheet P2 is ensured by a prescribed amount K longer than a distance (A-B) mm. For this reason, there is a case in which the inter-paper distance Lg between the subsequent sheet P2 preliminarily fed and the previous sheet P1 does not meet the prescribed amount K. For this reason, in this embodiment, after the preliminary feeding operation, the inter-paper distance Lg is calculated before the previous sheet P1 is next transported (paper transport), and it is determined whether or not the condition $Lg \geqq K$ is satisfied. If the condition $Lg \geqq K$ is not satisfied, during the next transport operation, only the previous sheet P1 is transported while the subsequent sheet P2 is stopped. If the condition $Lg \geqq K$ is satisfied, when the previous sheet P1 is transported, the subsequent sheet P2 is fed by the same distance. After the condition $Lg \geqq K$ is satisfied, each time the previous sheet P1 is transported, the subsequent sheet P2 is fed by the same distance while maintaining the inter-paper distance Lg. In this way, the inter-paper distance Lg between the sheets P1 and P2 is ensured by the prescribed amount K or more, and thus the leading end of the subsequent sheet P2 can be reliably detected by the paper detection sensor 47. Therefore, if a subsequent transport distance is counted on the basis of the detection position of the leading end of the subsequent sheet P2, a transport position of the subsequent sheet P2 can be grasped.

The feeding operation of the subsequent sheet P2 does not start immediately when the condition $Lg \geqq K$ is established during the paper transport operation, but the feeding operation of the subsequent sheet P2 starts after the next transport operation of the previous sheet P1 starts. The reason is as follows. If the pickup roller 35 is driven during the paper transport operation in which the intermediate roller 36 is rotating at a predetermined speed, a difference in speed occurs between a portion of the subsequent sheet P2 nipped between the intermediate roller 36 and the retard roller 37 and a portion of the subsequent sheet P2 in contact with the pickup roller 35 being accelerated on the upstream side in the feeding direction. This difference in speed may cause the subsequent sheet P2 being fed to be pulled between the portions and the subsequent sheet P2 may be damaged. In order to solve this problem, the feeding operation of the subsequent sheet P2 starts at the same timing as the timing at which the paper transport operation of the previous sheet P1 starts.

Next, the electrical configuration of a printer having an auto paper feeder will be described with reference to FIG. 4.

Figure 4:
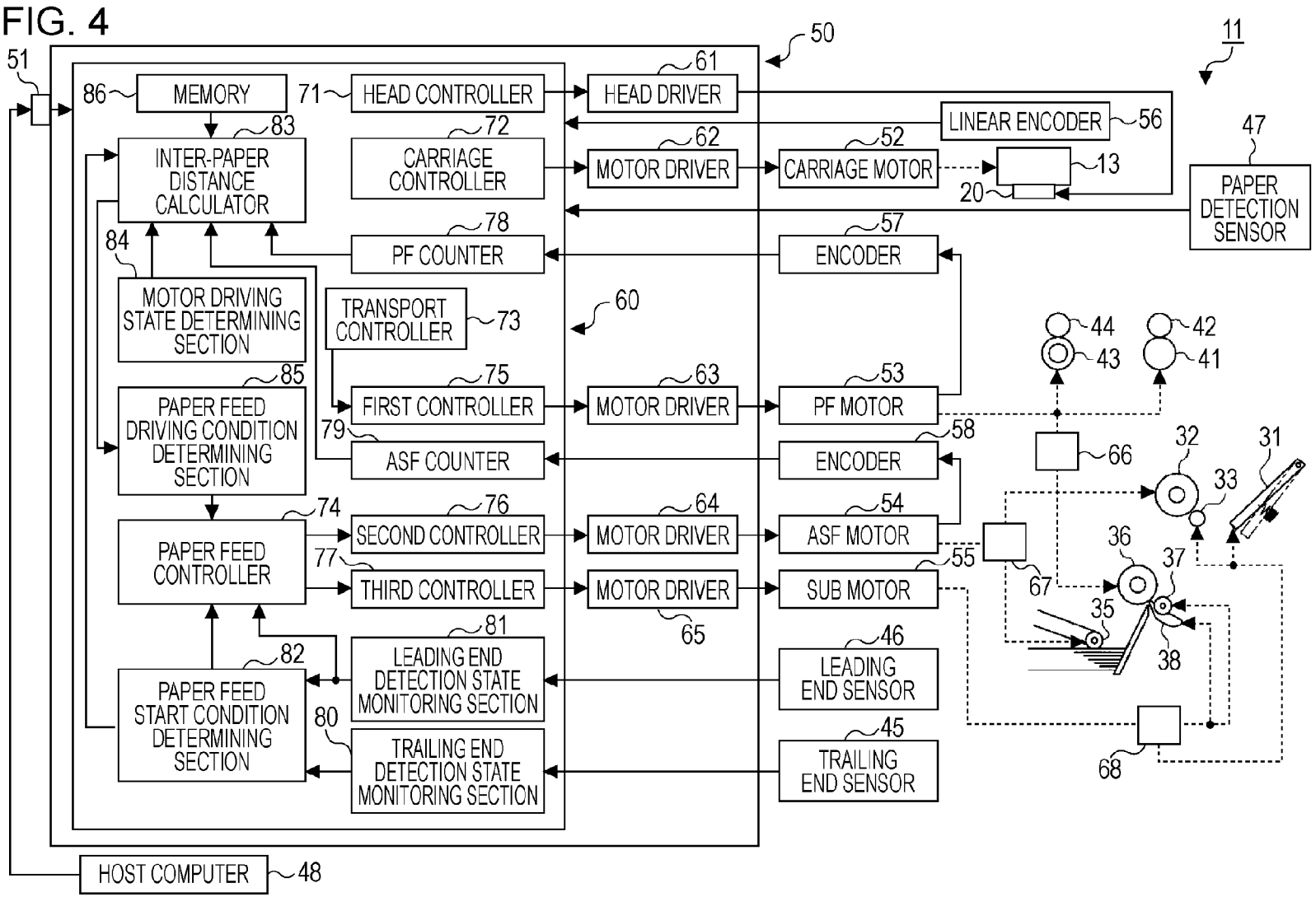
FIG. 4 is a block diagram showing the electrical configuration of the printer.

As shown in FIG. 4, the printer 11 includes a control section 50 that performs various kinds of control. The control section 50 is communicably connected to a host computer 48 (PC) through an interface 51, and controls the printer 11 on the basis of print data received from the host computer 48.

The control section 50 is connected to the carriage motor 52, the PF motor 53 (paper transport motor), the ASF motor 54 (automatic feeding motor), and a sub motor 55 (ASF-SUB motor) as an output system. The control section 50 is also connected to a linear encoder 56, encoder 57 and 58, the trailing end sensor 45, the leading end sensor 46, and the paper detection sensor 47 as an input system.

The control section 50 includes a controller 60, a head driver 61, and motor drivers 62, 63, 64, and 65. The controller 60 drives the recording head 20 on the basis of print data through the head driver 61, and draws an image or a document based on print data by dots of ink droplets. The controller 60 drives the carriage motor 52 through the motor driver 62, and controls the movement of the carriage 13 in the main scanning direction. At this time, input pulses from the linear encoder 56 are counted by a counter (not shown), and accordingly the controller 60 grasps a movement position of the carriage 13 with respect to an origin position (home position). The input pulses from the linear encoder 56 are also used to generate an ejection timing signal of the recording head 20.

The controller 60 also drives the PF motor 53 through the motor driver 63. An output shaft of the PF motor 53 is connected to the transport driving roller 41, the discharge driving roller 43, and the intermediate roller 36 through a series of wheels (not shown) so as to transmit power to them. If the PF motor 53 is forward driven, the transport driving roller 41, the discharge driving roller 43, and the intermediate roller 36 are rotated in the paper transport direction. If the PF motor 53 is reversely driven, the transport driving roller 41 and the discharge driving roller 43 are reversely driven due to the action of a clutch 66, but the intermediate roller 36 is not reversely driven.

The controller 60 also drives the ASF motor 54 through the motor driver 64. An output shaft of the ASF motor 54 is connected to the feed roller 32 and the pickup roller 35 through a series of wheels (not shown) so as to transmit power to them. A clutch 67 is interposed in a power transmission path between the ASF motor 54 and each of the rollers 32 and 35. When the ASF motor 54 is driven, a selected one of the rollers 32 and 35 is rotated in the paper feeding direction due to the movement of the clutch 67. Therefore, if the ASF motor 54 is forward driven, one of the feed roller 32 and the pickup roller 35 selected by the clutch 67 is rotated in the paper feeding direction.

The controller 60 also drives the sub motor 55 through the motor driver 65. An output shaft of the sub motor 55 is connected to the hopper 31 and the retard rollers 33 and 37 through a series of wheels (not shown) so as to transmit power to them. When the sub motor 55 is driven, one of a power transmission path of the rear feeder 22 and a power transmission path of the front feeder 23 is selected on the basis of the movement of a clutch 68. If the power transmission path of the rear feeder 22 is selected, the sub motor 55 is forward/reversely driven by a predetermined amount. Then, the hopper 31, the retard roller 33, and the sheet returning lever 34 are driven between a retreat position and a feeding position. If the power transmission path of the front feeder 23 is selected, the retard roller 37 and the sheet returning lever 38 are driven from the retreat position to the feeding position when the sub motor 55 is forward driven by a predetermined amount.

Meanwhile, when the sub motor 55 is reversely driven by a predetermined amount, the retard roller 37 and the sheet returning lever 38 are driven from the feeding position to the retreat position.

During printing, a user can activate a printer driver (not shown) in the host computer 48 to select the rear (sheet feeding tray) and the front (sheet feeding cassette) as a sheet feeding source by an operation of an input device. The controller 60 receives, from the host computer 48, print data which includes information regarding the selected sheet feeding source as one of printing conditions. The controller 60 controls a driving system to select the designated sheet feeding source on the basis of print data. That is, the controller 60 selects the connection states of the clutches 66 to 68 to select a sheet feeding source to be driven from among the rear feeder 22 and the front feeder 23.

The printer driver of the host computer 48 acquires various printing parameters, such as sheet size, sheet type, and layout, which are set by an operation of the user with the input device, and if an instruction to perform printing is received, generates printing image data by predetermined processing, such as resolution conversion, color conversion, halftone, and rasterization. Then, a command is attached to a header with printing image data as a body, thereby generating print data. The header includes various printing parameters starting with sheet type and sheet feeding source designation information, as well as the command.

The controller 60 includes a head controller 71, a carriage controller 72, a transport controller 73, a paper feed controller 74, a first controller 75, a second controller 76, a third controller 77, a PF counter 78, an ASF counter 79, a trailing end detection state monitoring section 80, a leading end detection state monitoring section 81, a paper feed start condition determining section 82, an inter-paper distance calculator 83, a motor driving state determining section 84, a paper feed driving condition determining section 85, and a memory 86. The controller 60 includes, for example, a CPU, an ASIC (Application Specific IC (specific-use IC)), a ROM, a RAM, a nonvolatile memory, and the like. The controller 60 is configured such that the CPU executes a program which is stored in the ROM, and shown in flowcharts of FIGS. 9 to 11. The controller 60 is not limited to software. For example, the controller 60 may be formed of hardware, such as an electronic circuit (for example, a custom IC), or a combination of software and hardware.

The head controller 71 drives the recording head 20 through the head driver 61. The carriage controller 72 drives the carriage motor 52 through the motor driver 62.

The first to third controllers 75 to 77 are a control section for a paper transport system. The first controller 75 drives the PF motor 53 through the motor driver 63. The second controller 76 drives the ASF motor 54 through the motor driver 64. The third controller 77 drives the sub motor 55 through the motor driver 65.

The rotation of the PF motor 53 is detected by the encoder 57 (rotary encoder), and a detection signal (encoder signal) is input to the PF counter 78. The PF counter 78 counts pulse edges of the encoder signal, and obtains a value corresponding to a paper transport amount with a sheet position during reset as an origin.

The rotation of the ASF motor 54 is detected by the encoder 58 (rotary encoder), and a detection signal (encoder signal) is input to the ASF counter 79. The ASF counter 79 counts pulse edges of the encoder signal, and obtains a value corresponding to a paper transport amount with a sheet position during reset as an origin.

The trailing end detection state monitoring section 80 monitors on the basis of a detection signal input from the trailing end sensor 45 whether or not the trailing end sensor 45 detects the trailing end of the previous sheet P1. Specifically, the trailing end detection state monitoring section 80 monitors whether or not the detection state of the trailing end sensor 45 is switched from "paper present" to "paper absent", and if the detection state is switched to "paper absent", changes a monitoring flag from "0" to "1". The leading end detection state monitoring section 81 monitors on the basis of a detection signal input from the leading end sensor 46 whether or not the leading end sensor 46 detects the leading end of the subsequent sheet P2. Specifically, the leading end detection state monitoring section 81 monitors whether or not the detection state of the leading end sensor 46 is switched from "paper absent" to "paper present", and if the detection state is switched to "paper present", changes a monitoring flag from "0" to "1".

The paper feed start condition determining section 82 inputs the monitoring results (monitoring flags) of the trailing end detection state monitoring section 80 and the leading end detection state monitoring section 81. In this embodiment, when the detection state of the trailing end by the trailing end sensor 45 is switched from "paper present" to "paper absent" during the paper transport operation of the previous sheet P1, the feeding operation of the subsequent sheet P2 starts. On the other hand, there may be a case in which, during the feeding operation of the previous sheet P1, the subsequent sheet P2 is double fed. In this embodiment, when double feeding occurs, the leading end of the subsequent sheet P2 is in contact with the sheet returning lever 38 in the closed position, and thus the position of the subsequent sheet P2 is restricted. In this case, however, the subsequent sheet P2 already passes by the preliminary feeding position (target position) (in FIG. 3, a position by a distance B away from the leading end sensor 46). For this reason, even though double feeding occurs and the trailing end of the previous sheet P1 is detected, the preliminary feeding operation of the subsequent sheet P2 is not performed.

The paper feed start condition determining section 82 determines whether or not to permit or inhibit the preliminary feeding operation of the subsequent sheet P2. That is, if the monitoring flag from the trailing end detection state monitoring section 80 is changed from "0" to "1", the paper feed start condition determining section 82 starts the determination processing. If the monitoring flag from the leading end detection state monitoring section 81 is "0" (leading end non-detection state), it is determined that a preliminary feeding start condition is established. If the monitoring flag is "1" (leading end detection state) it is determined that the preliminary feeding start condition is not established.

The paper feed start condition determining section 82 sends the determination result to the paper feed controller 74. The paper feed controller 74 selects one of the second and third controllers 76 and 77 as a destination of a motor driving instruction in accordance with the determination result. That is, if the preliminary feeding start condition is not established, the motor driving instruction is not output to the second controller 76, and the preliminary feeding operation of the subsequent sheet P2 is inhibited. If the preliminary feeding start condition is established, the motor driving instruction is output to both the second and third controllers 76 and 77 to start the preliminary feeding operation of the subsequent sheet P2. For this reason, if the preliminary feeding start condition is established, the second controller 76 drives the ASF motor 54, and the pickup roller 35 is forward driven in the feeding direction. In addition, the third controller 77 drives the sub motor 55. Accordingly, the sheet returning lever 38 is driven from the closed position (feeding restriction position) to the open position (feeding permission position), and the retard roller 37 is driven from the retreat position to the feeding position.

The paper feed controller 74 performs control the start and stop of the preliminary feeding operation. That is, after the preliminary feeding operation starts, the paper feed controller 74 monitors the flag of the leading end detection state monitoring section 81. Then, if the leading end sensor 46 detects the leading end of the subsequent sheet P2 and the detection state of the leading end sensor 46 is switched from "paper absent" to "paper present" (that is, if the flag is changed from "0" to "1"), the paper feed controller 74 resets the ASF counter 79. In addition, if the count value of the ASF counter 79 has reached a value corresponding to the prescribed distance B, in order to stop the feeding operation of the subsequent sheet P2, the paper feed controller 74 transmits an instruction to stop motor driving to the second controller 76. For this reason, the subsequent sheet P2 is stopped when the leading end thereof passes through the detection position of the leading end sensor 46 by the prescribed distance B (mm). The third controller 77 is stopped when the sheet returning lever 38 is driven to the feeding permission position and the retard roller 37 is driven to the feeding position.

When the subsequent sheet P2 is positioned at the feeding standby position (target position), it is determined in advance whether or not a main feeding start condition is established on which the transport operation of the previous sheet P1 and the feeding operation of the subsequent sheet P2 can be simultaneously performed during the next transport operation. If the main feeding start condition is established, the feeding operation is performed simultaneously with the next transport operation. The determination regarding whether or not the main feeding start condition is established is performed on the basis of the calculation value of the inter-paper distance Lg. For this calculation, the inter-paper distance calculator 83 is provided. The inter-paper distance calculator 83 calculates the inter-paper distance Lg on the basis of the count value of the PF counter 78, the count value of the ASF counter 79, and the set value stored in the memory 86. The memory 86 stores various kinds of set data, such as the transport distance between the trailing end sensor 45 and the leading end sensor 46 and the like, which are used to calculate the inter-paper distance.

When the transport controller 73 is requested to perform the next transport operation of the previous sheet, if the ASF motor 54 is not being driven, inter-paper distance calculation is performed immediately before the next transport operation starts. If the inter-paper distance Lg of a prescribed amount C or more is ensured, the main feeding operation is performed during the next transport operation. When the transport controller 73 is requested to perform the next transport operation of the previous sheet, if the ASF motor 54 is being driven, the inter-paper distance Lg is not calculated, and the transport operation of the previous sheet P1 is immediately performed, without waiting for until the preliminary feeding operation of the subsequent sheet P2 is stopped. In any cases, the time when the paper transport processing of the previous sheet is defined based on when the transport controller 73 is requested to perform the next transport operation of the previous sheet. A feeding distance until the subsequent sheet P2 reaches the feeding standby position varies depending on the number of sheets in the sheet feeding cassette 16 at the time of the start of the feeding operation. That is, when a small number of sheets remain in the sheet feeding cassette 16, as shown in FIGS. 2 and 3, an uppermost sheet is supplied from a low position close to the bottom of the sheet feeding cassette 16. Accordingly, as shown in FIG. 2, the feeding distance extends extra (for example, 40 to 80 mm), as compared with an uppermost sheet from among a substantially maximum number of sheets stacked in the sheet feeding cassette 16 near the maximum number of sheets. In such a case, the trailing end of the previous sheet P1 is detected by the trailing end sensor 45 during the transport operation of the previous sheet P1, and the transport operation ends when the preliminary feeding operation of the subsequent sheet P2 starts. Accordingly, even though it comes a time to start the next transport operation, that is, even though it comes a time to calculate the inter-paper distance, the preliminary feeding operation of the subsequent sheet P2 may be still continuing. In this case, the position (stop position) of the subsequent sheet P2 during the preliminary feeding operation is not fixed, and as a result, the inter-paper distance Lg cannot be calculated.

For this reason, in this embodiment, the driving state of the ASF motor 54 is monitored, and if the ASF motor 54 is being driven even though it comes a time to calculate the inter-paper distance Lg, the transport operation of the previous sheet P1 immediately start without waiting for until the preliminary feeding operation of the subsequent sheet P2 is stopped. When it comes a time to calculate the inter-paper distance Lg, the motor driving state determining section 84 determines the driving state of the ASF motor 54. Before the next transport operation, if it is determined that the ASF motor 54 is stopped, the motor driving state determining section 84 transmits a calculation start instruction to the inter-paper distance calculator 83. Meanwhile, if the ASF motor 54 is being driven and is not stopped until a predetermined time limit in the next transport operation reaches, the calculation start instruction is not transmitted. For this reason, if the instruction to start calculation is not received until the predetermined time limit elapses, the inter-paper distance calculator 83 does not calculate the inter-paper distance Lg.

If the preliminary feeding start condition is established and the preliminary feeding operation is performed, or the preliminary feeding start condition is not established and the preliminary feeding operation is not performed is indicated by the determination signal from the paper feed start condition determining section 82, the inter-paper distance calculator 83 changes a computational expression to be used to calculate the inter-paper distance Lg according to the details. That is, when the preliminary feeding operation is performed, a first computational expression is used on an assumption that the leading end of the subsequent sheet P2 is at the feeding standby position. Meanwhile, when the preliminary feeding operation is not performed, a second computational expression is used on an assumption that the leading end of the subsequent sheet P2 is at the feeding restriction position at which it is in contact with the sheet returning lever 38 in the closed state. The first computational expression and the second computational expression are described below.

First Computational Expression $$Lg=n+A-B \tag{1}$$

Second Computational Expression $$Lg=n+A-C \tag{2}$$

Here, n is a PF driving distance from a detection position, at which the detection state of the trailing end sensor 45 is switched from "paper present" to "paper absent", to the position of the trailing end of the previous sheet P1. "A" is a transport distance between a trailing end sensor 45 and a leading end sensor 46, and "B" is a prescribed distance. "C" is a transport distance (mm) from the leading end sensor 46 to the feeding restriction position (medium restriction position), at which the leading end of the subsequent sheet P2 is positioned when the leading end is in contact with and is restricted by the sheet returning lever 38. The distances A, B, and C are constants which are uniquely defined in design in accordance with the positions of the sensors 45 and 46 or the operation position of the sheet returning lever 38. In this example, the condition B<C<A is satisfied. When the inter-paper distance is calculated, the inter-paper distance calculator 83 sends the calculated inter-paper distance Lg to the paper feed driving condition determining section 85.

The paper feed driving condition determining section 85 determines on the basis of the inter-paper distance Lg whether to perform the feeding operation or not. In this embodiment, it is necessary to ensure the inter-paper distance Lg of the prescribed amount K (mm) or more. After the preliminary feeding operation is completed, the start of the main feeding operation is determined on the basis of whether or not the main feeding start condition Lg≧K is satisfied. Here, a minimum gap exists so as to ensure the paper detection sensor 47 to reliably detect the leading end of the subsequent sheet P2. The prescribed amount K (mm) is obtained by adding a predetermined margin to the minimum gap. The prescribed amount K is also set such that a skew removal operation is performed during the feeding operation of the subsequent sheet P2 without damaging the sheet. The skew removal operation indicates a series of operations, including nip and release operations, in which a part of the leading end of the subsequent sheet P2 is temporarily nipped between the pair of transport rollers 25, and the pair of transport rollers 25 are reversely driven to release the leading end of the subsequent sheet P2. In this example, when the previous sheet P1 is at a last row printing position according to the paper size, the prescribed amount K is set under a condition that the inter-paper distance Lg exists and the leading end of the subsequent sheet P2 on the upstream side in the transport direction is not nipped between the pair of transport rollers 25. For example, if the prescribed amount is set to such a value that the leading end of the subsequent sheet P2 is nipped between the pair of transport rollers 25, a relatively large amount of the leading end protrudes toward the downstream side in the transport direction from the nip point of the subsequent sheet P2 due to the release operation in the skew removal operation after last row printing. Accordingly, it is necessary to increase the amount of reverse rotation of the pair of transport rollers 25 for the release operation. In this embodiment, the intermediate roller 36 is only rotatable forward (paper transport direction) but is not rotatable reversely. If the amount of reverse rotation of the pair of transport rollers 25 is excessive, the subsequent sheet P2 may be excessively flexed between the pair of transport rollers 25 and the intermediate roller 36 during the release operation and may be damaged. In contrast, the prescribed amount K is set such that the amount of reverse rotation of the pair of transport rollers 25 during the release operation is not excessive. Therefore, the subsequent sheet P2 can be prevented from being excessively flexed and damaged during the release operation. The paper feed driving condition determining section 85 sends a main feeding instruction signal to the paper feed controller 74 only if it is determined the main feeding start condition Lg≧K is satisfied.

If the main feeding instruction signal is received from the paper feed driving condition determining section 85, the paper feed controller 74 drives the ASF motor in synchronization with driving of the PF motor during the next transport operation, and transmits the motor driving instruction to the second controller 76 such that the feeding operation is performed simultaneously with the transport operation. If the main feeding instruction signal is not received, no motor driving instruction is transmitted to the first to third controllers 75 to 77. For this reason, the inter-paper distance Lg of the prescribed amount K or more is ensured, and thus the main feeding operation is performed.

The next transport operation is as follows. If the instruction to start the transport operation is received from the carriage controller 72, the transport controller 73 transmits the motor driving instruction to the first controller 75 to drive the PF motor 53, and accordingly the pair of transport rollers 25, the pair of discharge rollers 26, and the intermediate roller 36 are forward driven at a predetermined speed profile in the transport direction. In this way, the next transport operation is performed. At this time, the second controller 76 acquires information regarding the amount of the next transport operation from the transport controller 73, and controls the speed of the ASF motor 54 at a feeding speed profile conforming to a transport speed profile defined by the information regarding the transport amount so as to be synchronous with the PF motor 53, such that the subsequent sheet P2 is fed at the same speed, in the same amount, and at the same transport timing as the previous sheet P1. At this time, in view of a difference in reduction ratio due to a difference in roller diameter between the PF system and the ASF system, the PF motor 53 and the ASF motor 54 are controlled such that the transport speed, the transport distance, and the transport timing are identical.

For example, if the main feeding operation is performed in a state where the inter-paper distance Lg is insufficient (Lg<K) and the subsequent sheet P2 is temporarily nipped between the intermediate roller 36 and the retard roller 37, the intermediate roller 36 is forward driven each time the previous sheet P1 is transported. For this reason, the inter-paper distance Lg is fixed to the insufficient initial value (Lg<K). The insufficient inter-paper distance Lg causes various problems. In this embodiment, therefore, the subsequent sheet P2 preliminarily feeds to the feeding standby position (target) near to the nip point between the intermediate roller 36 and the retard roller 37 and stands by at the feeding standby position. Then, after it is determined that the inter-paper distance Lg satisfies the condition Lg≧K, the main feeding operation is performed.

Next, the operation of the printer 11 will be described. First, a printing processing of the printer 11 will be described with reference to a flowchart of FIG. 9. If print data is received, the controller 60 executes a program shown in FIG. 9 and drives a printer engine on the basis of print data to perform the printing processing.

First, a paper feed processing is performed (Step S10). That is, in a state where the sub motor 55 is driven, and the retard roller 37 and the sheet returning lever 38 are at the feeding position indicated by the two-dot-chain line of FIG. 2, the ASF motor 54 and the PF motor 53 are driven. Then, the pickup roller 35 rotates, and accordingly the uppermost sheet P in the sheet feeding cassette 16 is fed. The leading end of the sheet P1 is detected by the paper detection sensor 47, and then the sheet P1 is transported by a predetermined distance. Thus, the paper feed processing ends. For example, if the sheet P1 is transported to a position to be nipped between the pair of transport rollers 25 and the paper feed processing ends, the sub motor 55 is driven. Then, the retard roller 37 is separated from the intermediate roller 36, and the sheet returning lever 38 is at the closed position to close a feeding port.

Next, a leading end setting processing is performed (Step S20). With a position of the sheet P1 at the time of end of the feeding operation as an origin, if a count value corresponding to a distance from the origin to a leading end setting position is counted by the PF counter 78, the PF motor 53 is stopped, and the sheet P1 is set to the leading end setting position. The sheet P1 is positioned at the printing start position by the leading end setting processing, and thus a paper transport processing in Step S30 is not performed in the leading end setting processing.

Next, a printing processing is performed (Step S40). That is, the carriage motor 52 is driven to move the carriage 13 in the main scanning direction, and ink droplets are ejected are ejected from the nozzles of the recording head 20 while the carriage 13 is moving. In this way, printing for one pass is performed.

It is determined whether or not printing for one page is completed (Step S50), and if printing is not completed, the paper transport processing (Step S30) and the printing processing (Step S40) are alternately performed until a discharge command is received and it is determined that printing for one page is completed. During the paper transport processing, the ASF motor 54 and the PF motor 53 are driven in accordance with a paper transport command, and the sheet is transported by the instructed transport amount.

If the discharge command is received and printing for one page is completed, it is determined whether or not the paper feeding operation is performed during the paper transport operation (Step S60). That is, when the trailing end of the previous sheet P1 is detected by the trailing end sensor 45 during the transport operation, it is determined whether or not the paper feeding operation of the subsequent sheet P2 is performed. If the paper feeding operation is not performed during the paper transport operation, the previous sheet P1 is not transported to a position at which the trailing end of the previous sheet P1 is detected by the trailing end sensor 45. In this case, therefore, a paper discharge processing is performed (Step S70). If the paper feeding operation is performed during the paper transport operation, the previous sheet P1 already passes by a position at which the trailing end of the previous sheet P1 is detected by the trailing end sensor 45. In this case, the paper discharge processing is not performed, and the process progresses to the paper feed processing (Step S10). Then, the subsequent sheet P2 is fed by the paper feed processing, and the previous sheet P1 is discharged.

After the paper discharge processing, it is determined whether or not all pages are printed (Step S80). If all the pages are not printed, the paper feed processing of a next page is performed (Step S10). If all the pages are printed, the routine ends.

Figure 5:
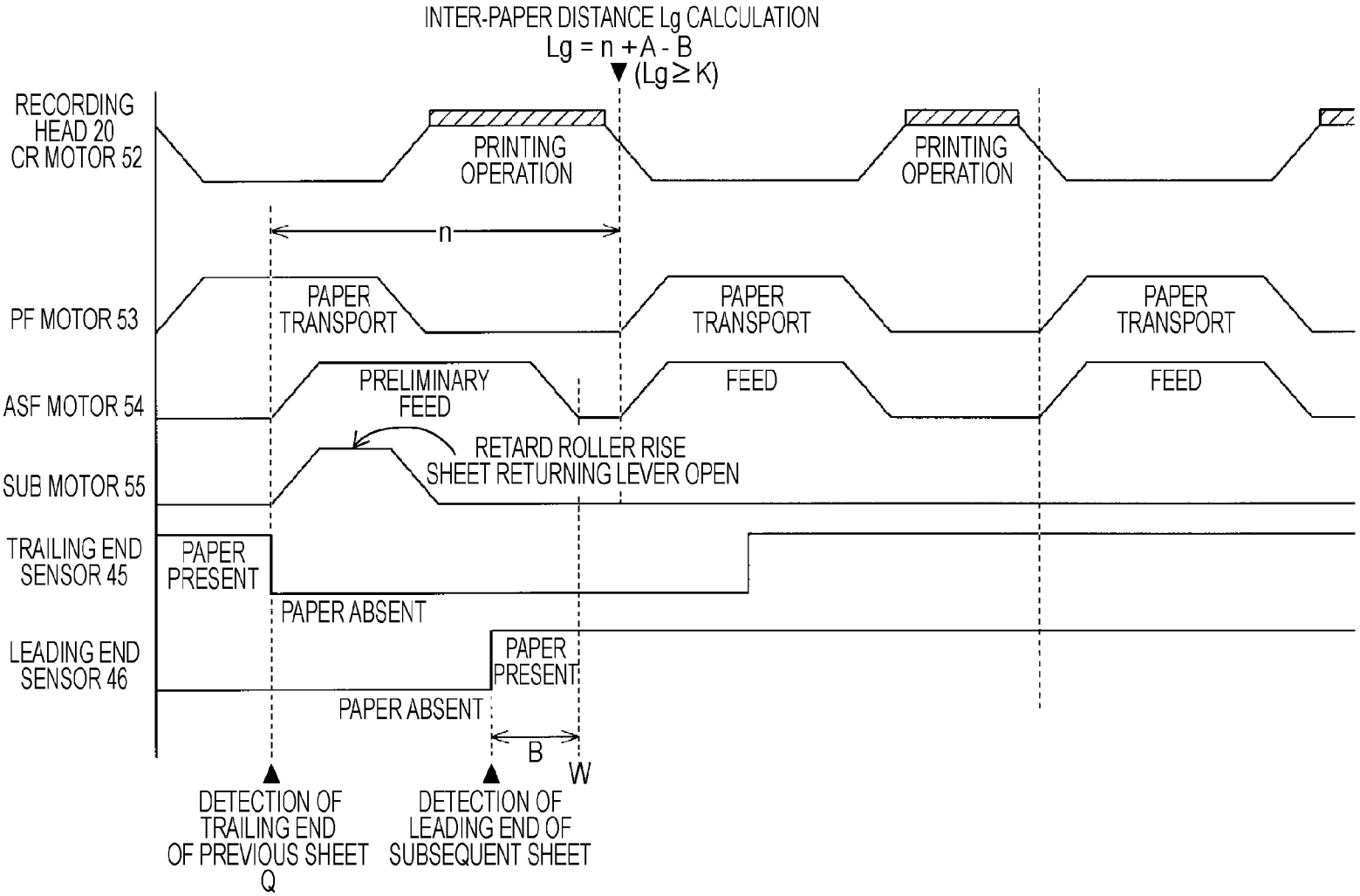
FIG. 5 is a timing chart showing a feed control processing for ensuring an inter-paper distance.
Figure 6:
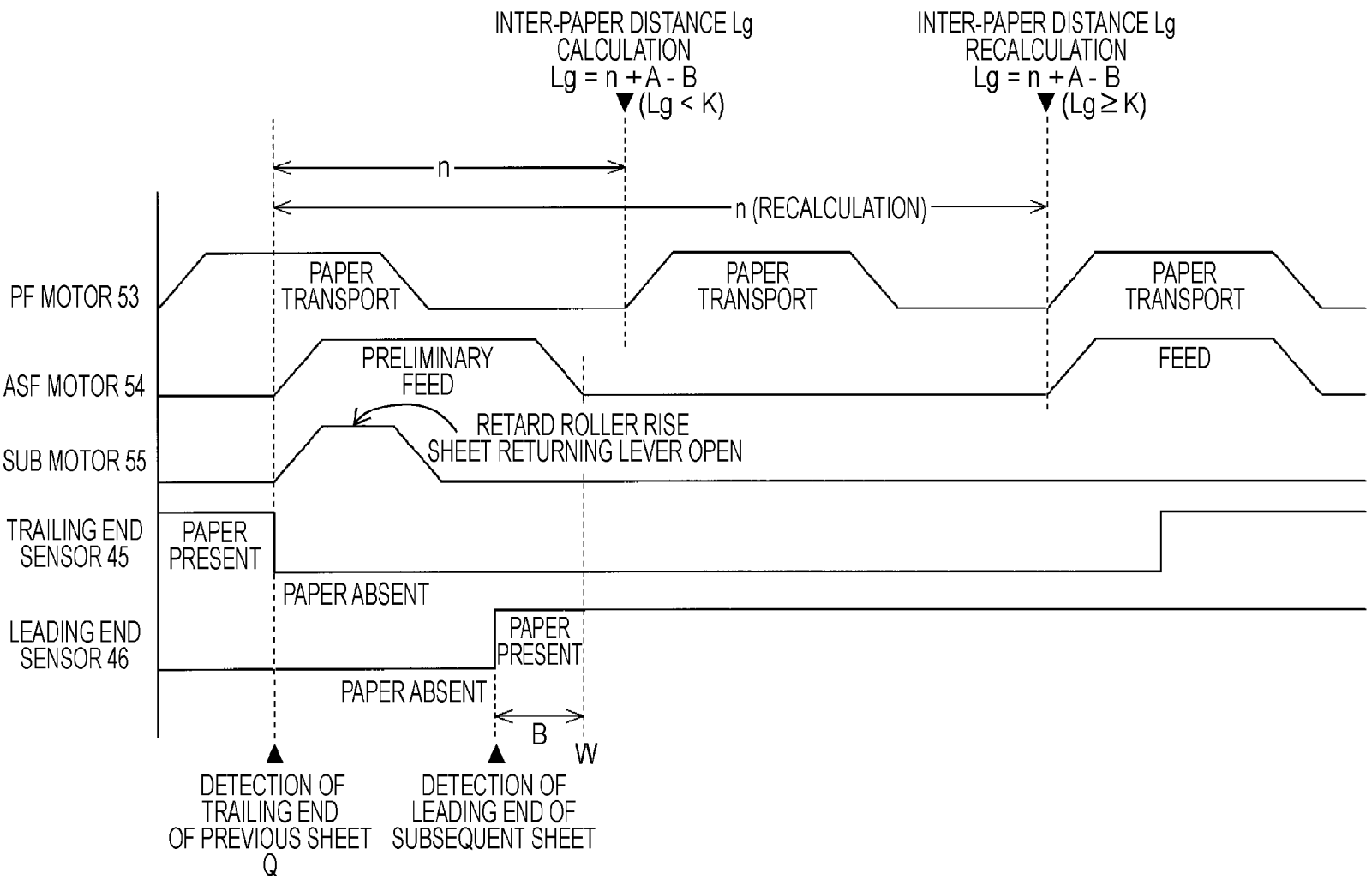
FIG. 6 is a timing chart showing a feed control processing for ensuring an inter-paper distance.
Figure 7:
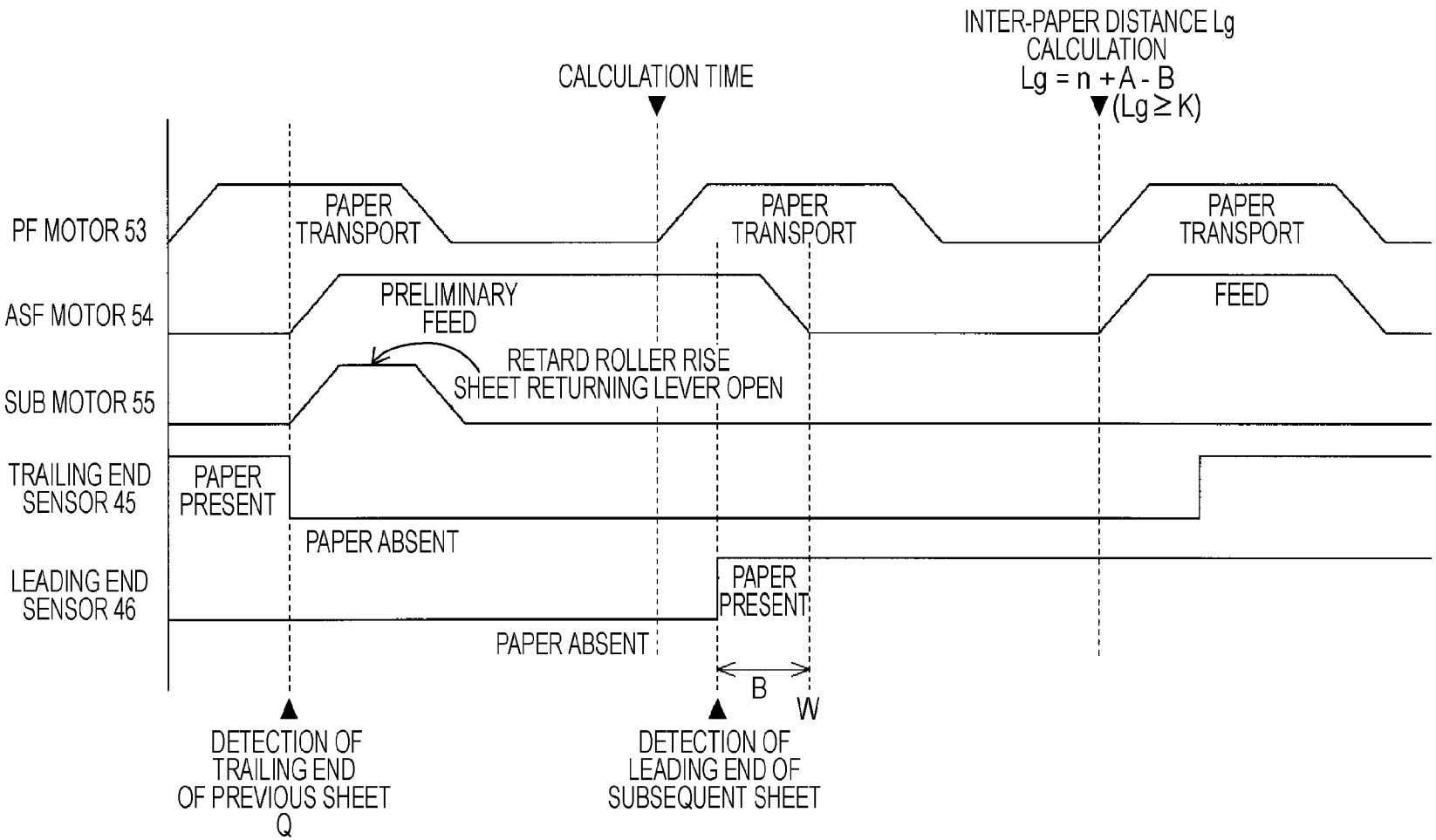
FIG. 7 is a timing chart showing a feed control processing for ensuring an inter-paper distance.
Figure 8:
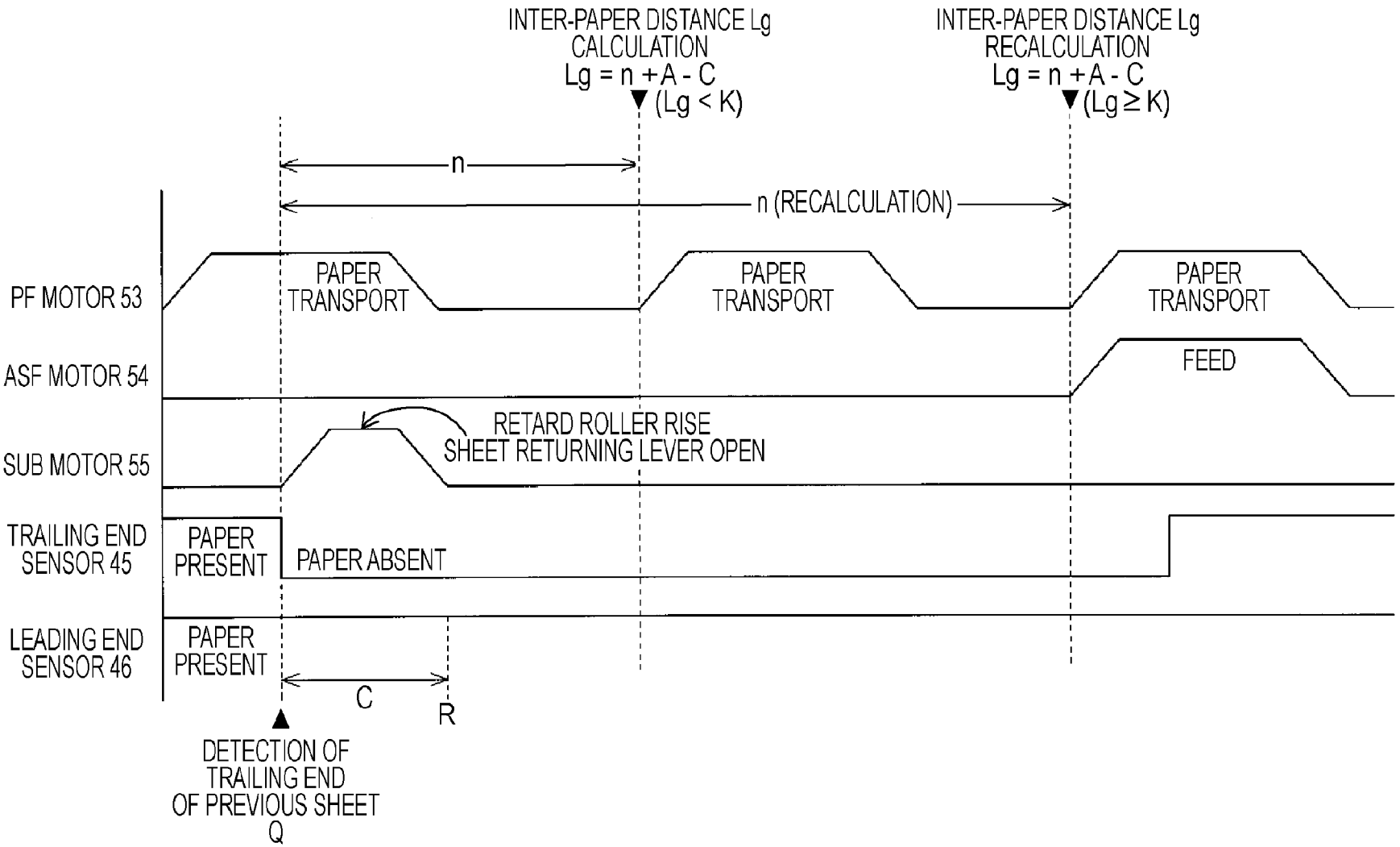
FIG. 8 is a timing chart showing a feed control processing for ensuring an inter-paper distance.
Figure 9:
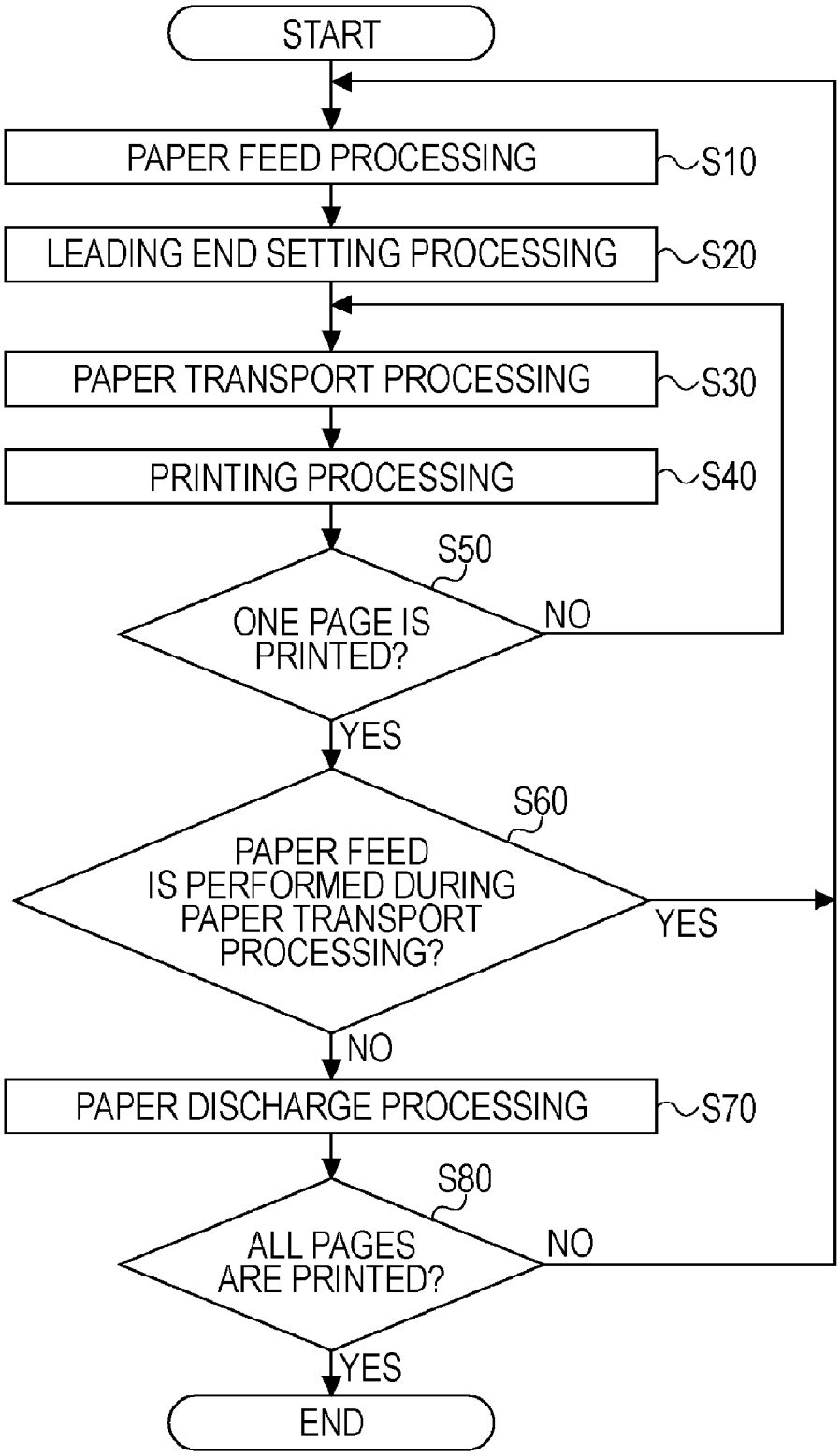
FIG. 9 is a flowchart showing a printing processing.

Next, the feed control processing in the printer 11 will be described. FIGS. 5 to 8 are timing charts when the feed control processing is performed. In the feed control of this embodiment, four kinds of control are branched off depending on the situations (a difference in transport amount, a difference in residual length of the sheet, presence/absence of double feeding, and the like). FIGS. 5 and 6 show a processing in a cast in which the preliminary feeding operation and the main feeding operation of the subsequent sheet P2 start during the paper transport operation with detection of the trailing end of the previous sheet P1 as a trigger. FIG. 7 shows a processing in a case in which the preliminary feeding operation is not performed in a state where the leading end sensor 46 is already in a detection state at the time of detection of the trailing end of the previous sheet P1. FIG. 8 shows a processing in a case in which the ASF motor 54 is continuously driven when it comes a time to calculate the inter-paper distance after the preliminary feeding operation of the subsequent sheet P2 starts with detection of the trailing end of the previous sheet P1 as a trigger, and before the next transport operation.

Hereinafter, the feed control processing of the printer in the above-described cases will be sequentially described with reference to FIGS. 5 to 8.

FIG. 5 is a timing chart showing the operation timing of the recording head 20, the carriage motor 52 (in the drawing, CR motor), the PF motor 53, the ASF motor 54, and the sub motor 55 during the feed control processing, together with the detection states of the trailing end sensor 45 and the leading end sensor 46. The operation timing of the carriage motor 52 and the recording head 20 is shown only in FIG. 5.

During printing, the printing operation and the paper transport operation are alternatively performed, and then printing is performed on the previous sheet P1. For this reason, the carriage motor 52 and the PF motor 53 are alternately driven. In FIG. 5, during a constant-speed period in which the carriage motor 52 is driven at a constant speed, ink droplets are ejected from the recording head 20 (in FIG. 5, a hatched region). The PF motor 53 for the transport operation of the previous sheet P1 starts to be driven after the ink droplets are ejected from the recording head 20. At this time, the transport amount is defined by the command in print data, and the previous sheet P1 is transported to a printing position of a next row (next line).

During the transport operation of the previous sheet P1, it is monitored whether or not the detection state of the trailing end sensor 45 is switched from "paper present" to "paper absent". As shown in FIG. 5, if the previous sheet P1 is transported during printing, the trailing end of the previous sheet P1 reaches a preliminary feeding start position Q, and the trailing end sensor 45 detects the trailing end of the previous sheet P1. In this state, if it is detected that the detection state of the trailing end sensor 45 is switched from "paper present" to "paper absent", the ASF motor 54 and the sub motor 55 are driven. As the ASF motor 54 is driven, the preliminary feeding operation of the subsequent sheet P2 starts from the set position in the sheet feeding cassette 16. During the preliminary feeding operation, it is monitored whether or not the detection state of the leading end sensor 46 is switched from "paper absent" to "paper present". If it is detected that the detection state of the leading end sensor 46 is switched from "paper absent" to "paper present", the ASF counter 79 starts to measure the ASF transport distance. If the measured distance has reached the prescribed distance B (mm), the ASF motor 54 is stopped. With this preliminary feeding operation, the subsequent sheet P2 is delivered to the feeding standby position W (target position).

As the sub motor 55 is driven, the retard roller 37 is raised and positioned at the feeding position (a position indicated by a two-dot-chain line in FIG. 2) to be in contact with the intermediate roller 36. Simultaneously, the sheet returning lever 38 is positioned at the open position (a position indicated by a two-dot-chain line in FIG. 2) and the feeding port is opened. As the sheet returning lever 38 is opened, the subsequent sheet P2 can enter a gap (nip point) between the intermediate roller 36 and the retard roller 37, and the main feeding operation to further transport the subsequent sheet P2 from the feeding standby position is prepared.

During the preliminary feeding operation, the subsequent sheet P2 is delivered to the feeding standby position W in front of the nip point between the intermediate roller 36 and the retard roller 37. For this reason, even though the intermediate roller 36 which has the same power source (PF motor 53) as the transport driving roller 41 rotates during the transport operation of the previous sheet P1, the subsequent sheet P2 is not fed. In this state, the subsequent sheet P2 is fed when the ASF motor 54 is driven.

Subsequently, the printing operation is performed and it comes a calculation time before a predetermined time (for example, 5 to 20 milliseconds) from the next transport operation, the inter-paper distance Lg is calculated. That is, the inter-paper distance Lg=n+A−B is calculated by the first computational expression (Expression (1)). In this case, the PF counter 78 is reset when the leading end sensor 46 detects the trailing end of the previous sheet P1, and subsequently, counts the pulse edges of the signal input from the encoder 57. In this way, the PF driving distance "n" corresponding to the amount of rotation of the PF motor 53 from the detection position of the trailing end of the previous sheet P1 (the preliminary feeding start position Q) is obtained as the count value. The inter-paper distance Lg is calculated on the basis of the PF driving distance n and the constants A and B by the first computational expression.

FIG. 5 shows an example where, during an initial transport operation after the preliminary feeding operation, the main feeding start condition is satisfied, that is, the inter-paper distance Lg is equal to or more than the prescribed amount K (Lg≧K).

If the condition Lg≧K is satisfied, and the necessary inter-paper distance Lg is ensured, as shown in FIG. 5, the ASF motor 54 is driven in synchronization with the PF motor 53 for the next transport operation of the previous sheet P1 is driven. Then, the main feeding operation in which the transport operation of the previous sheet P1 and the feeding operation of the subsequent sheet P2 are simultaneously performed is performed. In this case, the PF motor 53 and the ASF motor 54 are controlled such that the transport speed of the previous sheet P1 is substantially identical to the feeding speed of the subsequent sheet P2. For this reason, during the main feeding operation, the inter-paper distance Lg between the previous sheet P1 and the subsequent sheet P2 is maintained. Subsequently, each time the PF motor 53 is driven for the transport operation, the ASF motor 54 is simultaneously driven. Therefore, the transport operation of the previous sheet P1 and the feeding operation of the subsequent sheet P2 are simultaneously performed while the inter-paper distance Lg is maintained.

FIG. 6 shows an example in which, during an initial transport operation after the preliminary feeding operation, the inter-paper distance Lg does not satisfy the main feeding start condition Lg≧K. Up to the preliminary feeding operation of the subsequent sheet P2 is the same as the example of FIG. 5. However, if the inter-paper distance Lg calculated by the first computational expression before the next transport operation is less than the prescribed amount K (Lg<K), and an insufficient inter-paper distance is ensured, as shown in FIG. 6, when the PF motor 53 for the next transport operation is driven, the ASF motor 54 is not driven, and only the transport operation of the previous sheet P1 is performed. As a result, the inter-paper distance Lg between the previous sheet P1 and the subsequent sheet P2 increases by the transport amount of the previous sheet P1.

Before the next transport operation, the inter-paper distance Lg is recalculated by the first computational expression. In this case, the PF driving distance n represented by the count value of the PF counter 78 increases by the previous transport amount. If the calculated inter-paper distance Lg is equal to or more than the prescribed amount K (Lg≧K), as shown in FIG. 6, the ASF motor 54 is driven in synchronization with the PF motor 53 for the next transport operation, and the transport operation of the previous sheet P1 and the feeding operation of the subsequent sheet P2 are simultaneously performed. As a result, the previous sheet P1 and the subsequent sheet P2 are transported together while the inter-paper distance Lg is maintained. Subsequently, each time the PF motor 53 for the transport operation is driven, the ASF motor 54 is simultaneously driven, and thus the transport operation of the previous sheet P1 and the feeding operation of the subsequent sheet P2 are simultaneously performed while the inter-paper distance Lg is maintained. Meanwhile, if Lg<K, only the transport operation of the previous sheet P1 is performed again. That is, only the transport operation of the previous sheet P1 is performed until the inter-paper distance Lg calculated before the next transport operation satisfies the main feeding start condition Lg≧K. Then, if the condition Lg≧K is satisfied, during a subsequent transport operation, the feeding operation of the subsequent sheet P2 is performed together while the inter-paper distance Lg is maintained.

FIG. 7 shows a processing in a case in which, even though it comes to a time to calculate the inter-paper distance Lg, the ASF motor 54 for the preliminary feeding operation is continuously driven. In this case, when the ASF motor 54 is stopped and the position of the subsequent sheet P2 is not decided, the inter-paper distance Lg may not be decided, and the inter-paper distance Lg may not be calculated. When this happens, if it waits for until the ASF motor 54 is stopped, a time to start the next transport operation is delayed and throughput is deteriorated. In this embodiment, if the ASF motor 54 is continuously driven when it comes a time to calculate, the PF motor 53 is driven immediately without waiting for until the ASF motor 54 is stopped. With this transport operation, the trailing end of the previous sheet P1 is moved by the transport amount toward the downstream side in the transport direction.

When it comes a time to calculate before the next transport operation, if the ASF motor 54 is stopped, the inter-paper distance Lg is calculated by the first computational expression. If the calculated inter-paper distance Lg satisfies the main feeding start condition Lg≧K, the ASF motor 54 is driven in synchronization with the PF motor 53 for the next transport operation. Therefore, the transport operation of the previous sheet P1 and the feeding operation of the subsequent sheet P2 are simultaneously performed while the inter-paper distance Lg is maintained. If the main feeding start condition Lg≧K is not satisfied, the ASF motor 54 is not driven, and only the PF motor 53 is driven to perform the transport operation of the previous sheet P1. With this transport operation, the inter-paper distance Lg increases by the transport amount. Subsequently, the same processing as that in FIG. 6 is performed.

FIG. 8 shows a processing in a case in which the preliminary feeding operation is not performed in a state where the detection state of the leading end sensor 46 is already "paper present" at the time of detection of the trailing end of the previous sheet P1. For example, when the subsequent sheet P2 is double fed while the previous sheet P1 is fed, the subsequent sheet P2 is separated from the previous sheet P1 by the retard roller 37. Therefore, there is no case in which subsequent sheet P2 exceeds the retard roller 37 toward the downstream side in the transport direction. If the previous sheet P1 is fed, the sub motor 55 is driven, and the retard roller 37 is lowered and separated from the intermediate roller 36. Simultaneously, the sheet returning lever 38 is rotated to the closed position. As a result, the leading end of the double fed subsequent sheet P2 is in contact with the sheet returning lever 38. In addition, when the subsequent sheet P2 is double fed at the time of the transport operation of the previous sheet P1 after the sheet returning lever 38 is closed, the leading end of the subsequent sheet P2 is in contact with the sheet returning lever 38. Therefore, the subsequent sheet P2 is restricted so as to be no longer transported toward the downstream side in the transport direction.

As shown in FIG. 8, if the detection state of the trailing end sensor 45 is switched from "paper present" to "paper absent" during the transport operation of the previous sheet P1, when the detection state of the leading end sensor 46 is already "paper present", it may be considered that the subsequent sheet P2 has reached the feeding restriction position R and is in contact with the sheet returning lever 38 due to double feeding. In this case, at the feeding restriction position R, the leading end of the subsequent sheet P2 exceeds the feeding standby position W by a predetermined distance toward the downstream side in the transport direction, and thus the ASF motor 54 for the preliminary feeding operation is not driven.

If it comes a time to calculate before the next transport operation, the inter-paper distance Lg is calculated. In this case, the leading end of the subsequent sheet P2 is regarded as being at the feeding restriction position R at which the subsequent sheet P2 is in contact with the sheet returning lever 38, and accordingly the second computational expression $Lg=n+A-C$ is used. In the second computational expression, the constant C is identical to the ASF driving distance between the detection position of leading end of the subsequent sheet P2 and the feeding restriction position R. With the second computational expression, the inter-paper distance Lg which is identical to a transport distance between the feeding restriction position R and the position of the trailing end of the previous sheet P1 is calculated.

It is determined whether or not the calculated inter-paper distance Lg is equal to or more than the prescribed amount K. If the condition $Lg \geqq K$ is established, the PF motor 53 and the ASF motor 54 are simultaneously driven. If the condition $Lg \geqq K$ is not established, the ASF motor 54 is not driven, and only the PF motor 53 is driven. When the subsequent sheet P2 is double fed, the subsequent sheet P2 is already transported to the feeding restriction position R beyond the feeding standby position W. For this reason, the inter-paper distance Lg is relatively short, and the main feeding start condition $Lg \geqq K$ is likely to be established, as compared with the subsequent sheet P2 is at the feeding standby position W. If the condition $Lg \geqq K$ is not established, while the position of the subsequent sheet P2 is maintained, only the transport operation of the previous sheet P1 is performed. Thus, the inter-paper distance Lg increases. If the inter-paper distance Lg calculated before a subsequent transport operation satisfies the condition $Lg \geqq K$, the ASF motor 54 is driven in synchronization with the PF motor 53. Therefore, the transport operation of the previous sheet P1 and the feeding operation of the subsequent sheet P2 are simultaneously performed, while the inter-paper distance Lg is maintained.

Figure 10:
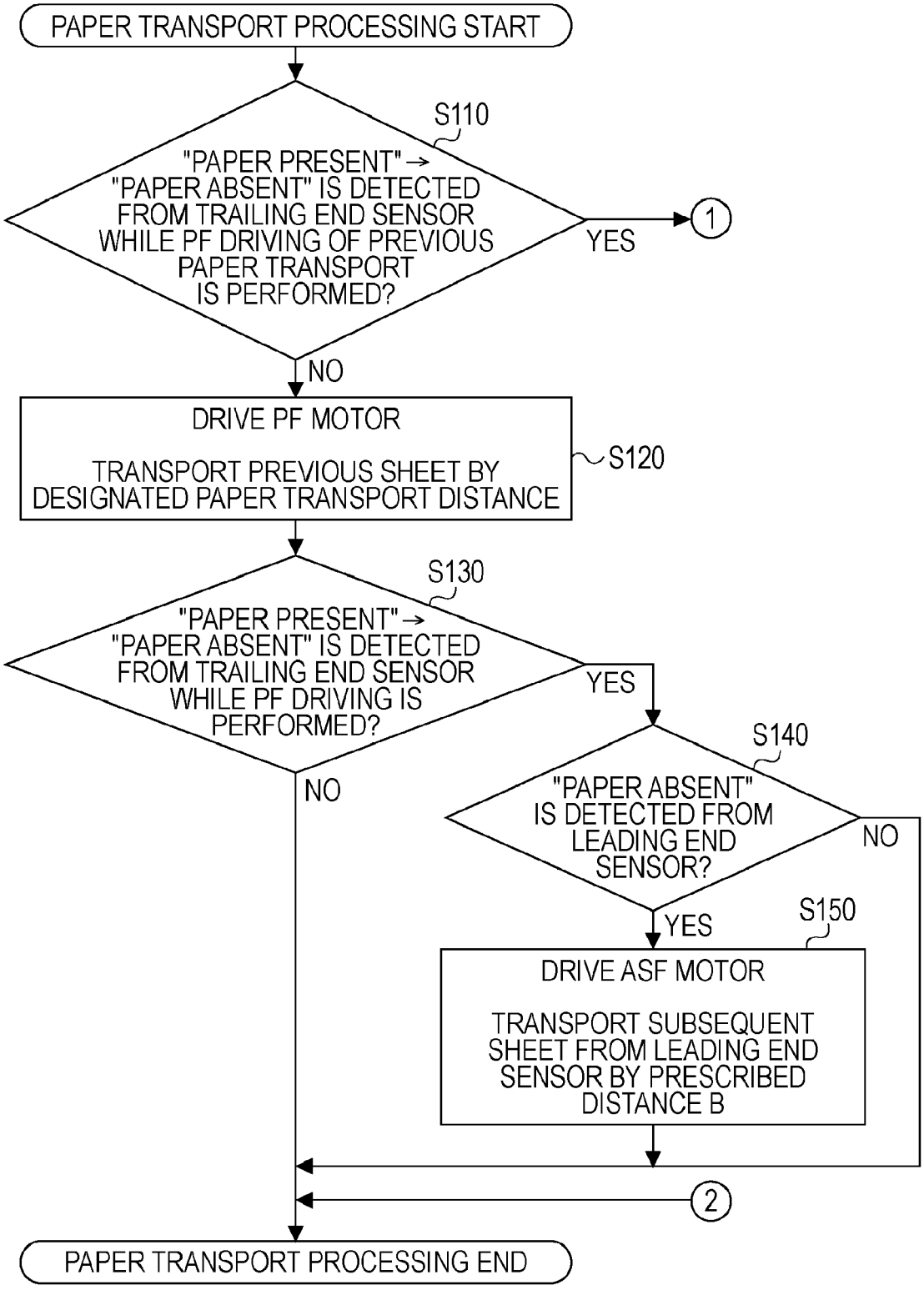
FIG. 10 is a flowchart showing a feed control processing (paper transport processing).
Figure 11:
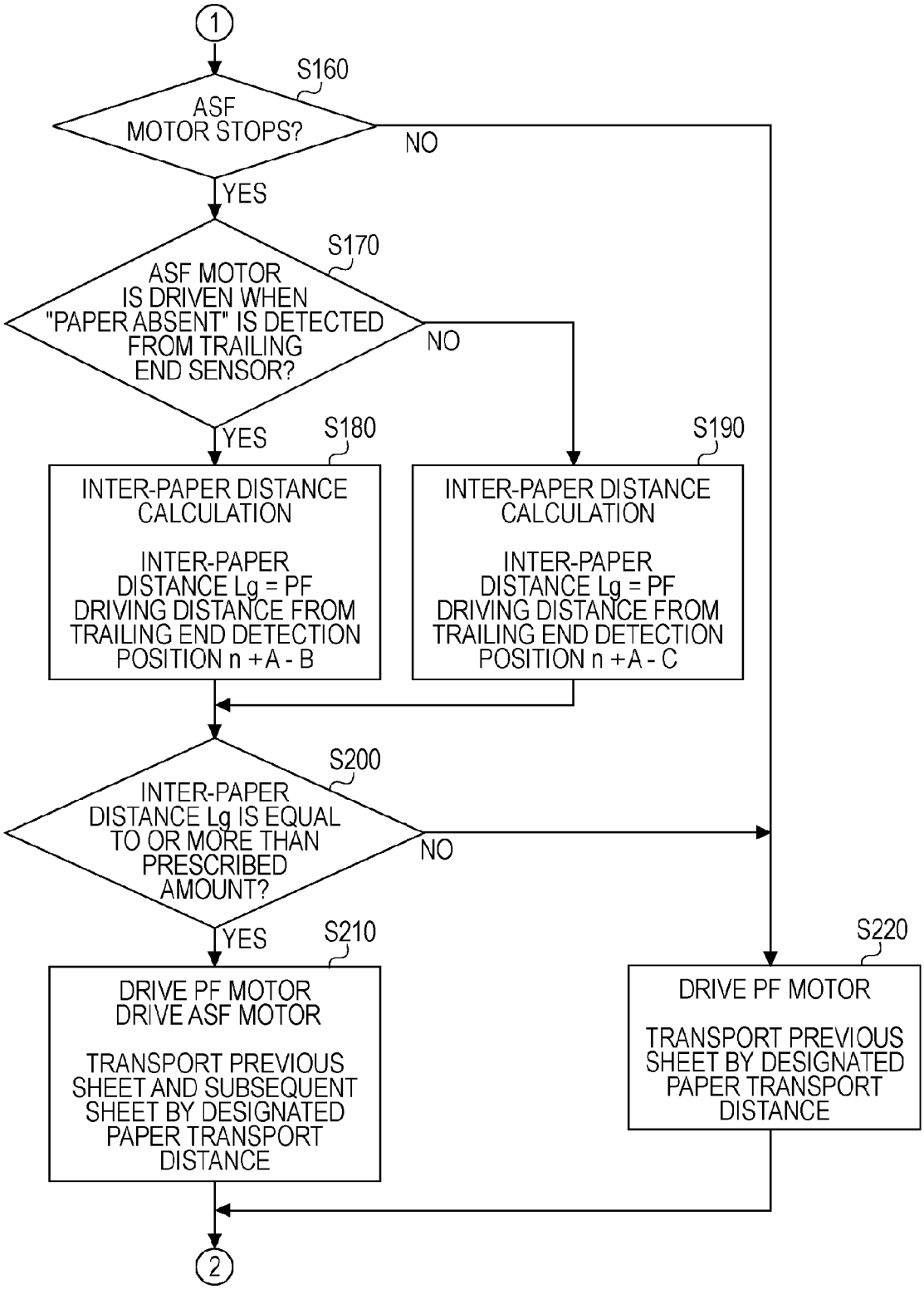
FIG. 11 is a flowchart showing a feed control processing (paper transport processing).

FIGS. 10 and 11 are flowcharts showing the feed control processing. Hereinafter, the feed control processing of the printer will be described with reference to FIGS. 10 and 11, in addition to FIGS. 5 to 8 with respect to the above-described cases. In the following description, the driving of the PF motor 53 may be referred to as "PF driving", and the driving of the ASF motor 54 may be referred to as "ASF driving".

In Step S110 of FIG. 10, it is determined whether or not the detection state of the trailing end sensor 45 is switched from "paper present" to "paper absent" during the PF driving of the previous transport operation. This determination is performed on the basis of the value of the flag for storing the monitoring result of the trailing end detection state monitoring section 80, which monitors the detection state of the trailing end sensor 45. The trailing end detection state monitoring section 80 monitors the detection state of the trailing end sensor 45 during the PF driving. If the detection state is "paper present", a trailing end flag is set to "1", and if the detection state is "paper absent", the trailing end flag is set to "0". If the value of the flag is changed from "1" to "0", a previous transport flag is changed from "0" to "1". The determination in Step S110 is performed by the paper feed start condition determining section 82 on the basis of the value of the previous transport flag. If the detection state is changed from "paper present" to "paper absent" during previous PF driving (that is, the previous transport flag=1), the process progresses to Step S160 of FIG. 11. If the switching of the detection state from "paper present" to "paper absent" is not detected (that is, the previous transport flag=0), the process progresses to Step S120. The previous transport flag is changed from "1" to "0" when the detection state of the trailing end sensor 45 is switched from "paper absent" to "paper present" during the PF driving.

In Step S120, the PF motor 53 is driven to transport the previous sheet P1 by a designated transport distance. In this case, the ASF motor 54 is not driven, and only the transport operation of the previous sheet P1 is performed. Step 120 corresponds to performing of a transport operation.

In Step S130, it is determined whether or not the detection state of the trailing end sensor 45 is switched from "paper present" to "paper absent" during the PF driving. This determination is performed by the trailing end detection state monitoring section 80. If the detection state of the trailing end sensor 45 is switched from "paper present" to "paper absent" during the PF driving, the process progresses to Step S140. If the switching of the detection state is not detected, the paper transport processing ends. In Step S130, if the determination is false, the trailing end detection state monitoring section 80 changes the previous transport flag from "0" to "1".

In Step S140, it is determined whether or not the detection state of the leading end sensor 46 is "paper absent". This determination is performed by the paper feed start condition determining section 82 on the basis of the monitoring result of the leading end detection state monitoring section 81. The leading end detection state monitoring section 81 monitors the detection state of the leading end sensor 46. If the detection state is "paper present", a leading end flag is set to "1", and if the detection state is "paper absent", the leading end flag is set to "0". The paper feed start condition determining section 82 performs the determination in Step S140 on the basis of the value of the leading end flag. If the determination result is "paper absent", the process progresses to Step S150, and if the determination result is "paper absent" (that is, "paper present"), the paper transport processing ends. As in the example of FIG. 8, when the subsequent sheet P2 is double fed while the previous sheet P1 is fed and transported, if the detection state of the trailing end sensor 45 is switched from "paper present" to "paper absent", the detection state of the leading end sensor 46 is already "paper present". In such a case, during the PF driving, the ASF driving is not performed. Steps S130 and S140 correspond to a processing in which the paper feed start condition determining section 82 determines on the monitoring results of the trailing end detection state monitoring section 80 and the leading end detection state monitoring section 81 whether or not the paper feed start condition for starting the preliminary feeding operation of a sheet in the sheet feeding cassette 16 is established.

If the detection state of the leading end sensor 46 is "paper absent" (that is, the paper feed start condition is established), in Step S150, the ASF motor 54 is driven. Specifically, Step S150 is performed by the paper feed controller 74. In Step S150, when receiving a paper feed start instruction from the paper feed start condition determining section 82, the paper feed controller 74 executes a predetermined paper feed sequence and outputs an instruction to the second controller 76 and the third controller 77. The paper feed controller 74 executes the predetermined paper feed sequence to first drive the ASF motor 54. During the ASF driving, if the fact that the detection state of the leading end sensor 46 is switched from "paper absent" to "paper present" is acquired from the leading end detection state monitoring section 81, the ASF counter 79 is reset. If the ASF counter 79 has reached a count value corresponding to the prescribed distance B (mm) the ASF motor 54 is stopped. In this way, the subsequent sheet P2 is preliminary fed to the feeding standby position shown in FIG. 3, at which the leading end of the subsequent sheet P2 is positioned on the downstream side in the transport direction by the prescribed distance B (mm) from the leading end sensor 46 (the detection position of the leading end). This corresponds to the "preliminary feeding operation" in which the ASF motor 54 is initially driven, in the examples of FIGS. 5 to 7. The uppermost sheet (subsequent sheet P2) in the sheet feeding cassette 16 is fed from the set position. Then, the leading end of the sheet reaches the detection position of the leading end sensor 46 and is further fed by the prescribed distance B (mm) after the detection state of the leading end sensor 46 is switched from "paper absent" to "paper present". The determination in Step S130 and the ASF driving in Step S150 correspond to preliminary feeding of a subsequent medium.

In Step S110, if the detection state of the trailing end sensor 45 is switched from "paper present" to "paper absent" during the PF driving of the previous transport operation (in Step S110, if the determination is false), the process progresses to Step S160 of FIG. 11. That is, when the ASF motor 54 is driven during the previous PF driving to start the preliminary feeding operation, the process progresses to Step S160.

In Step S160, it is determined whether or not the ASF motor 54 is stopped. This determination is performed by the motor driving state determining section 84. If the ASF motor 54 is stopped, the process progresses to Step S170, and if the ASF motor 54 is being driven, the process progresses to Step S220.

In Step S220, the PF motor 53 is driven to transport the previous sheet P1 by the designated transport distance. In this case, the ASF motor 54 is not driven for the main feeding operation, and only the transport operation of the previous sheet P1 is performed. That is, as shown in FIG. 7, even though it comes a time to calculate before the next transport operation starts, when the ASF motor 54 is still driving (that is, the preliminary feeding operation) if it comes a time to start the transport operation, the PF motor 53 is driven to start the transport operation of the previous sheet P1, and places priority on printing throughput of the previous sheet P1, without waiting for until the preliminary feeding operation is completed. Steps S160 and S220 correspond to placing priority on a transport operation.

In Step S170, it is determined whether or not the ASF motor 54 is driven when the detection state of the trailing end sensor 45 is switched from "paper present" to "paper absent". That is, it is determined whether or not the preliminary feeding operation is performed when the trailing end of the previous sheet P1 is detected. When the detection state of the leading end sensor 46 is "paper absent", the preliminary feeding operation is not performed. Meanwhile, when the detection state of the leading end sensor 46 is "paper present", the subsequent sheet P2 is regarded as being already fed to the feeding restriction position R due to double feeding, and thus the preliminary feeding operation is not performed. When the ASF driving (the preliminary feeding operation) is performed, the paper feed start condition determining section 82 set an ASF driving flag to "1", and the paper feed driving condition determining section 85 performs determination on the basis of the value of the ASF driving flag. When the ASF driving is performed (the determination is false), the process progresses to Step S180. When the ASF driving is not performed (the determination is true), the process progresses to Step S190.

In Step S180, the inter-paper distance Lg is calculated by the first computational expression. That is, the inter-paper distance Lg is calculated by the expression $Lg=n+A-B$. In the examples of FIGS. 5 to 7, in which the preliminary feeding operation is performed, and the leading end of the subsequent sheet P2 is positioned at the feeding standby position on the downstream side in the transport direction by the prescribed distance B from the leading end detection position, in Step S180, the inter-paper distance Lg is calculated by the first computational expression.

In Step S190, the inter-paper distance Lg is calculated by the second computational expression. That is, the inter-paper distance Lg is calculated by the expression $Lg=n+A-C$. In the example of FIG. 8, in which the sheets P1 and P2 are double fed, the preliminary feeding operation is not performed, and the leading end of the subsequent sheet P2 is positioned at the feeding restriction position R at which the leading end is in contact with the sheet returning lever 38, in Step S190, the inter-paper distance Lg is calculated by the second computational expression. Steps S180 and S190 correspond to acquiring of a determination value (measuring).

In Step S200, it is determined whether or not the inter-paper distance Lg is equal to or more than the prescribed amount K. If the condition $Lg \geqq K$ is satisfied, the process progresses to Step S210. If the condition $Lg \geqq K$ is not satisfied (that is, $Lg<K$), the process progresses to Step S220.

In Step S210, the PF motor 53 and the ASF motor 54 are driven together. In this case, the transport controller 73 drives the PF motor 53 by the designated transport distance, and the paper feed controller 74 drives the ASF motor 54 in synchronization with the PF motor 53 such that the transport speed and amount of the previous sheet P1 are the same as the transport speed and amount of the subsequent sheet P2. With this driving, the previous sheet P1 and the subsequent sheet P2 are transported by the designated transport distance while the inter-paper distance Lg is maintained.

If the inter-paper distance Lg is less than the prescribed amount K ($Lg<K$), in Step S220, the PF motor 53 is driven to transport the previous sheet P1 by the designated transport distance. In this case, the ASF motor 54 is not driven, and only the transport operation of the previous sheet P1 is performed. For example, as shown in FIGS. 6 and 8, with respect to the inter-paper distance Lg calculated before the initial transport operation after the trailing end of the previous sheet P1 is detected (in FIG. 6, after the preliminary feeding operation starts), if $Lg<K$, during the driving of the PF motor 53 for initial transport operation after the trailing end is detected, the ASF motor 54 is not driven. As a result, while the position of the subsequent sheet P2 (for example, the feeding standby position or the feeding restriction position) is maintained, only the transport operation of the previous sheet P1 is performed. Thus, the inter-paper distance Lg increases by the transport distance. After the paper transport processing (Step S220), when a subsequent transport operation is performed, similarly, the inter-paper distance Lg is calculated (Step S180 or S190), and the inter-paper distance Lg is determined (Step S200). If the condition $Lg \geqq K$ is satisfied, during the corresponding transport operation, the PF motor 53 and the ASF motor 54 are synchronously driven. Therefore, the previous sheet P1 and the subsequent sheet P2 are transported together while the inter-paper distance Lg is maintained. Steps S200 and S220 correspond to performing of main feeding control.

In this way, during the printing of the previous sheet P1, the feeding operation of the subsequent sheet P2 (at least the preliminary feeding operation from among the preliminary feeding operation and the main feeding operation) is performed. If one page of the previous sheet P1 is printed (YES in Steps S50 and S60 of FIG. 9), the process progresses to the paper feed processing (Step S10) of the subsequent sheet P2, not the paper discharge processing (Step S70). During the paper feed processing (Step S10) of the subsequent sheet P2 and the leading end setting processing (Step S20), the previous sheet P1 is discharged. While the last page is being printed, the feeding operation of the subsequent sheet P2 is not performed during the transport operation. Therefore, after printing is completed, the paper discharge processing (Step S70) is performed. When the page is printed before the trailing end of the previous sheet P1 is detected by the trailing end sensor 45, the paper discharge processing (Step S70) is performed. The paper discharge processing is performed to a position at which the trailing end of the subsequent sheet P2 is detected by the trailing end sensor 45 or the leading end sensor 46. Subsequently, the process progresses to the paper feed processing (Step S10).

For example, the feeding distance of the subsequent sheet P2 varies depending on whether a maximum number of sheets or a minimum number of sheets are stacked in the sheet feeding cassette 16. That is, as shown in FIG. 2, when a maximum number of sheets are stacked, the pickup roller 35 is positioned at a position indicated by the upper two-dot-chain line near to the intermediate roller 36. Meanwhile, when a minimum number of sheets are stacked, the pickup roller 35 is positioned at a position indicated by the lower two-dot-chain line (the same as the position of the pickup roller in FIG. 3) away from the intermediate roller 36. When a minimum number of sheets are stacked, the transport distance of the subsequent sheet P2 extends. In this case, when the trailing end of the previous sheet P1 passes through the preliminary feeding start position Q, the preliminary feeding operation is performed to deliver the subsequent sheet P2 to the feeding standby position in advance. Subsequently, the previous sheet P1 and the subsequent sheet P2 are simultaneously transported while the necessary inter-paper distance Lg of the prescribed amount K or more is ensured. Therefore, only if the trailing end of the previous sheet P1 passes by the preliminary feeding start position Q, even though printing of the previous sheet P1 ends at some point, the subsequent sheet P2 is fed to a position on the upstream side in the transport direction by the inter-paper distance Lg from the trailing end of the previous sheet P1. As a result, the feeding distance after the paper feed processing of the subsequent sheet P2 is performed can be shortened, without depending on the number of sheets in the sheet feeding cassette, and thus printing throughput can be improved.

As described above in detail, according to this embodiment, the following effects are obtained.

(1) The trailing end sensor 45 and the leading end sensor 46 are individually provided on the downstream side and the upstream side in the transport direction with the position opposing the retard roller 37 serving as a separation unit in the feeding path interposed therebetween. If the trailing end of the previous sheet P1 is detected by the trailing end sensor 45, the feeding operation of the subsequent sheet P2 starts from the set position in the sheet feeding cassette 16, and the subsequent sheet P2 is further fed by the prescribed distance B (mm) after the leading end of the subsequent sheet P2 is detected by the leading end sensor 46. Next, the inter-paper distance Lg is calculated before the next transport operation, and it is confirmed that the calculated inter-paper distance Lg is equal to or more than the prescribed amount K. Subsequently, the PF driving and the ASF driving are simultaneously performed, and the transport operation of the previous sheet P1 and the feeding operation of the subsequent sheet P2 are performed while the inter-paper distance Lg is maintained. As a result, when the previous sheet P1 (one page) is printed, the subsequent sheet P2 is immediately fed at the inter-paper distance Lg. For this reason, if the paper feed processing is performed, the subsequent sheet P2 is set to a printing start position in a relatively small transport amount, and thus printing on the subsequent sheet P2 can early start. Therefore, printing throughput can be improved.

(2) After the feeding operation to the feeding standby position, the inter-paper distance Lg is calculated before the next transport operation starts, and it is determined whether or not the calculated inter-paper distance Lg is equal to or more than the prescribed amount K. If the condition $Lg \geqq K$ is satisfied, during the transport operation, the ASF motor 54 is driven together with the PF motor 53, and the feeding operation of the subsequent sheet P2 is performed. If the condition $Lg \geqq K$ is not satisfied (that is, $Lg < K$), as the PF motor 53 is driven, the ASF motor 54 is not driven, and only the transport operation of the previous sheet P1 is performed. Thus, the inter-paper distance Lg increases. In this way, the feeding operation of the subsequent sheet P2 is performed while it is confirmed that a necessary inter-paper distance Lg is ensured. Therefore, even though the transport distance between the detection position of the trailing end of the previous sheet P1 and the feeding standby position, which is the target position of the subsequent sheet P2 to be preliminary fed, is less than the prescribed amount K, a necessary inter-paper distance Lg can be reliably ensured. In addition, during the main feeding operation, the ASF driving and the PF driving are performed at the substantially same driving distance, driving start timing, and driving speed. As a result, the feeding operation of the subsequent sheet P2 can be performed while the necessary inter-paper distance Lg can be ensured.

(3) Even though it comes a time to calculate the inter-paper distance Lg set after the preliminary feeding operation starts and immediately before the next transport operation start, when the ASF motor 54 is continuously driven (the preliminary feeding operation is still continuing), the PF motor 53 for the next transport operation starts, without waiting for until the ASF motor 54 is stopped. For this reason, printing of a next row onto the previous sheet P1 can early start, as compared with a case in which the transport operation starts after the ASF motor 54 is stopped, and thus printing throughput can be improved.

(4) When the trailing end sensor 45 detects the trailing end of the previous sheet P1, it is determined whether or not the leading end sensor 46 detects the leading end of the subsequent sheet P2. If the leading end of the subsequent sheet P2 is detected, the ASF motor 54 is not driven, and the preliminary feeding operation is not performed. Accordingly, even though the sub motor 55 for preparation of the main feeding operation is driven with detection of the trailing end of the previous sheet P1 as a trigger, and the retard roller 37 and the sheet returning lever 38 are positioned at the time of the feeding operation, it is possible to prevent the subsequent sheet P2 from being nipped between the intermediate roller 36 and the retard roller 37 before the inter-paper distance Lg is confirmed. For example, if the transport operation is necessarily performed in a predetermined amount enough to reach the target position when the trailing end sensor 45 detects the previous sheet P1, the subsequent sheet P2 is nipped between the intermediate roller 36 and the retard roller 37. Accordingly, even though the inter-paper distance Lg does not meet the prescribed amount K, when the PF motor 53 for the transport operation of the previous sheet P1 is driven, the intermediate roller 36 is rotated with the PF motor 53 as a driving source. In this case, even though the ASF motor 54 is not driven, the subsequent sheet P2 is forcibly fed. According to this embodiment, however, if the leading end of the subsequent sheet P2 is already detected, the ASF motor 54 is not driven. As a result, it is possible to prevent the subsequent sheet P2 from being fed when the inter-paper distance Lg does not meet the prescribed amount K.

(5) When the trailing end of the previous sheet P1 is detected, if the leading end of the subsequent sheet P2 is not detected, and the preliminary feeding operation is performed, the inter-paper distance Lg is calculated by the first computational expression Lg=n+A−B with the prescribed distance B corresponding to the target position as a constant. Meanwhile, when the trailing end of the previous sheet P1 is detected, if the leading end of the subsequent sheet P2 is already detected, and the preliminary feeding operation is not performed, the leading end of the subsequent sheet P2 is regarded as being at the feeding restriction position R at which the leading end of the subsequent sheet P2 is in contact with the sheet returning lever 38. In this case, the inter-paper distance Lg is calculated by the second computational expression Lg=n+A−C with the distance C from the trailing end detection position to the feeding restriction position R as a constant. Therefore, even though the subsequent sheet P2 exceeds the target position due to double feeding before the preliminary feeding operation is performed, the inter-paper distance Lg between the previous sheet P1 and the subsequent sheet P2 can be relatively accurately calculated.

(6) Even though the inter-paper distance Lg is equal to or more than the prescribed amount K, during the transport operation, the main feeding operation does not start. Specifically, after the condition Lg≧K is satisfied, when it comes a time to start the next transport operation of the previous sheet P1, the main feeding operation starts such that the feeding start timing of the subsequent sheet P2 is synchronized with the start timing of the next transport operation. For example, if the feeding operation starts during the transport operation, the driving of the ASF motor 54 starts in a state where the PF motor 53 is already rotated at high speed. In this case, the subsequent sheet P2 may be pulled between the intermediated roller 36, which rotates at high speed with the PF motor 53 as a driving source, and the pickup roller 35, which rotates at constant speed in the course of acceleration with the ASF motor 54 as a driving source, and be damaged due to a difference in speed between the intermediate roller 36 and the pickup roller 35. In this embodiment, however, it is possible to prevent the subsequent sheet P2 from being damaged due to excessive tension caused by the difference in speed between the rollers. In particular, in this embodiment, at the time of main feeding, the PF motor 53 and the ASF motor 54 are controlled such that the PF motor 53 and the ASF motor 54 have the substantially same driving start timing, transport speed, and driving stop timing. Therefore, it is possible to reliably prevent the subsequent sheet P2 from being damaged due to excessive tension caused by the difference in speed between the rollers.

The invention is not limited to the embodiment, but the following modifications may be applicable.

(Modification 1) The target position is not limited to a fixed position, but it may be variable. For example, the target position may vary depending on a target transport position of the previous sheet P1. That is, when the trailing end sensor 45 detects the trailing end of the previous sheet P1 during the transport operation of the previous sheet P1, a position on the downstream side in the feeding direction at a necessary inter-paper distance (for example, the prescribed amount K) from the trailing end position of the previous sheet P1 after completion of the transport operation defined by the target transport position of the previous sheet P1 at that time may be calculated as the target position, and the preliminary feeding operation may be performed in accordance with the calculated target position. In this case, even though the transport distance from the detection position of the trailing end of the previous sheet P1 when the preliminary feeding operation is performed and the target transport position varies depending on the transport amount at that time, the subsequent sheet P2 can be preliminarily fed to the target position separated by an appropriate inter-paper distance substantially identical the prescribed amount from the trailing end of the previous sheet P1. Therefore, when an initial (next) transport operation after the preliminary feeding operation starts, the inter-paper distance Lg can be appropriately ensured, and the inter-paper distance can be prevented from excessively increasing. In this case, even though it comes a time to calculate the inter-paper distance Lg, if the preliminary feeding operation of the subsequent sheet is still continuing, the transport operation of the previous sheet starts immediately after it comes a time to start the transport operation, without waiting for until the preliminary feeding operation is stopped.

(Modification 2) In the foregoing embodiment, a necessary inter-paper distance (that is, the prescribed amount K) is fixed, but it may be variable. For example, the prescribed amount K may vary depending on a printing mode, a transport speed, or a paper size. Like the sheet feeding device described in JP-A-2005-22792 (paragraphs [0029] to [0054]), when the inter-paper distance is determined in accordance with the detection position of the sensor, it is difficult to set the inter-paper distance variable. In this embodiment, however, if the trailing end position of the previous sheet P1 is measured, an inter-paper distance is calculated on the basis of the measurement value (that is, the PF driving distance n), and the start timing of the main feeding operation is determined on the basis of the calculated inter-paper distance, a prescribed amount can be selected from a plurality of prescribed amount Kn (n=1, 2, . . . ) stored in a memory in accordance with the printing condition. Therefore, a necessary inter-paper distance can be relatively simply variable.

(Modification 3) The determination value is not limited to the gap. For example, a distance between the leading ends of the sheets, an inter-center distance of the sheets, or a distance between the leading end of the previous sheet P1 and the trailing end of the subsequent sheet P2 may be used as the determination value.

(Modification 4) The calculation time (measurement time) when the inter-paper distance is calculated is not limited to immediately before start of the next transport operation. For example, any time from when the current transport operation is completed with the trailing end of previous sheet detected until the final calculation start time, which is permitted so as to complete calculation and determination of the inter-paper distance before the next transport operation starts may be set. In addition, even though the ASF motor is driven at the calculation time, when a standby time (for example, several 100 milliseconds) exists until the transport operation starts, a second calculation time is set immediately before the transport operation starts. Even though the second calculation time comes, if the ASF motor is continuously driven, the transport operation starts immediately when it comes a time to start the transport operation. Meanwhile, when the second calculation time comes, if the ASF motor is stopped, the main feeding operation may be performed. In this case, the second calculation time may be set several times.

(Modification 5) The trailing end sensor and the leading end sensor may not be separately provided, but may be formed of a single common sensor. If the common sensor detects the trailing end of the previous sheet, and it is detected that the trailing end has reached the preliminary feeding start position, the preliminary feeding operation of the subsequent sheet starts. If the leading end of the subsequent sheet is detected by the common sensor, or if the leading end of the subsequent sheet is detected by the common sensor, and then the subsequent sheet is further fed by the prescribed distance B and reaches the target position, a structure for stopping the preliminary feeding operation may be used. In addition, after the trailing end of the previous sheet P1 is detected, the transport amount of the previous sheet P1 may be measured to confirm that the trailing end moves to a predetermined position separated by a predetermined transport distance from the sensor detection position toward the downstream side in the transport direction, and then the preliminary feeding operation of the subsequent sheet P2 may start. The paper detection sensor 47 may be used for the single common sensor.

(Modification 6) The trailing end sensor and the leading end sensor are provided on both sides of the paper transport path with the intermediate roller, but at least the leading end sensor may be positioned on the upstream side in the transport direction by the intermediate roller. That is, with respect to a transport unit (roller) (in the foregoing embodiment, the intermediate roller 36), which is positioned on an uppermost stream side in the transport direction, from among a transport unit (in the foregoing embodiment, the transport driving roller 41, the discharge driving roller 43, and the intermediate roller 36), which is driven to transport the previous sheet during the recording operation, the leading end sensor may be positioned on the upstream side in the transport direction. The target position at the time of the preliminary feeding operation may be positioned on the upstream side with respect to the transport unit (roller) on the uppermost stream side in the transport direction.

(Modification 7) Even if the inter-paper distance is equal to or more than the prescribed amount, each time the transport operation is performed, the inter-paper distance may be measured in advance, and it may be determined on the basis of measured inter-paper distance whether to perform the transport operation of the previous sheet and the feeding operation of the subsequent sheet together or not.

(Modification 8) In the foregoing embodiment, the prescribed distance B is set, and the subsequent sheet P2 is further fed from the leading end detection position by the prescribed distance B and then stopped, but the prescribed distance may not be provided. That is, when the leading end sensor 46 detects the leading end of the subsequent sheet P2, the ASF motor 54 may be stopped. In this case, in a printer in which a distance in the transport path between the sensors 45 and 46 (that is, a distance between the feeding start position and the target position at the time of the preliminary feeding operation) is less then the prescribed amount K required as the inter-paper distance, a sufficient inter-paper distance can also be ensured.

(Modification 9) The invention may be applied to a printer in which the distance between the feeding start position and the target position at the time of the preliminary feeding operation is equal to or more than the prescribed amount K required as the inter-paper distance. For example, even though the previous sheet and the subsequent sheet are double fed, a sufficient inter-paper distance can also be ensured.

(Modification 10) The computational expression for calculating the inter-paper distance Lg varies depending on whether or not the detection state of the leading end sensor 46 is "paper present" when the trailing end of the previous sheet P1 is detected. Alternatively, the same computational expression may be used insofar as a necessary inter-paper distance Lg is ensured. For example, if the second computational expression is constantly used, when double feeding occurs, the time to start the main feeding operation is delayed once, but a necessary inter-paper distance can be reliably ensured.

(Modification 11) The PF motor 53 and the ASF motor 54 are provided, and the PF driving system and the ASF driving system use separate driving sources. Alternatively, the same driving source (same motor) may be used, and a clutch may be used to switch power transmission to separately drive the PF driving system and the ASF driving system.

(Modification 12) In case of a serial printer, a dot impact recording type or a thermal transfer recording type may be applicable, in addition to an ink jet recording type.

(Modification 13) A recording apparatus is not limited to the printer. Alternatively, the invention may be applied to another liquid ejection type recording apparatus for ejecting a liquid other than ink. Herein, "recording" is not limited to recording based on printing. For example, "recording" includes an operation to form a wiring pattern or an image on a circuit board serving as a medium by ejecting a liquid-state material including a material having a predetermined characteristic. For example, the invention may be applied a liquid ejection apparatus (recording apparatus) for ejecting a liquid-state material, in which a material, such as an electrode material or a color material is dispersed or dissolved, used to manufacture a liquid crystal display, an EL (Electro Luminescence) display, and a field emission display. When a feeding unit sequentially feeds sheet-like substrates one by one, and a recording unit forms a predetermined pattern on a substrate to be fed, throughput can be improved while a gap between the substrates serving as a medium can be ensured. As a result, productivity can be improved.

Hereinafter, technical ideas capable of being understood from the embodiment and the modifications will be described.

(1) In the method according to any one of claims 1 to 5, the transport unit and the feeding unit include separate driving sources.

(2) In the method according to any one of claims 2 to 5, when the main feeding operation is performed in the controlling of the main feeding operation, before every transport operation of the previous medium, the calculating and the controlling of the main feeding operation are repeatedly performed until the main feeding operation is performed.

(3) In the method according to any one of claims 1 to 5, in the measuring, the trailing end position of the previous medium is measured by a trailing end measuring unit (78), and a distance in a transport path between the trailing end position and the target position is measured as the gap by using the measurement value of the trailing end position.

What is claimed is:

1. A method of feeding a medium, the method comprising:

preliminarily feeding a subsequent medium such that a leading end of the subsequent medium becomes close to a trailing end of a previous medium being recorded;

after the preliminary feeding starts and before a transport operation of the previous medium starts, determining if the preliminary feeding is completed based on whether a feeding motor is driving the preliminary feeding or whether the driver is no longer driving the preliminary feeding and the previous medium and the subsequent medium are both stopped, acquiring a determination value according to a gap between the previous medium and the subsequent medium; and performing the transport operation of the previous medium, wherein, in the performing of the transport operation, when the determination value represents an appropriate gap between the previous medium and the subsequent medium, main feeding operation of the subsequent medium is performed while the transport operation of the previous medium is being performed, and when the determination value represents no appropriate gap, the main feeding operation of the subsequent sheet is not performed while the transport operation of the previous medium is being performed, wherein the determination value is acquired based on a detection result from a first detection sensor and a second detection sensor, each of which is provided at a position between a location where the preliminary feeding starts and a location where the transport operation starts, the first detection sensor detecting a trailing end of the previous medium while the second detection sensor detects the leading end of the subsequent medium, such that the determination value is the gap between the trailing end of the previous medium and the leading end of the subsequent medium, and when it comes a time to acquire the determination value, if the preliminary feeding operation is still continuing, no determination value is acquired, and the transport operation of the previous medium starts.

2. The method according to claim 1, wherein, when it comes a time to acquire the determination value, if the preliminary feeding operation is still continuing, in the acquiring of the determination value before a next transport operation of the previous medium starts, the determination value is acquired, and when the next transport operation is performed, it is determined on the basis of the determination value whether to perform the main feeding operation or not.

3. The method according to claim 1, wherein the acquiring of the determination value is performed immediately before the transport operation of the previous medium starts.

4. The method according to claim 1, wherein, in the performing of the transport operation, when the previous medium in the transport operation has reached a preliminary feeding start position desired for starting the preliminary feeding of the subsequent medium, if the subsequent medium already has reached a target position of the preliminary feeding, the preliminary feeding is not performed, and if the subsequent medium has not yet reached the target position of the preliminary feeding, the preliminary feeding is performed, the method further includes:

determining whether to perform the preliminary feeding or not, and in the acquiring of the determination value, when the preliminary feeding is performed, the determination value is calculated by a first computational expression, and when the preliminary feeding is not performed, the determination value is calculated by a second computational expression.

5. A recording apparatus comprising:

a recording unit that performs recording onto a medium;

a feeding unit that feeds the medium, the feeding unit being driven by a feeding driver;

a transport unit that transports the fed medium, in such a manner as to alternate with recording of the recording unit;

a preliminary feeding unit that preliminarily feeds a subsequent medium such that a leading end of the subsequent medium becomes close to a trailing end of a previous medium being recorded;

a determination value acquiring unit including a first detection sensor and a second detection sensor, each of which is provided at a position between a location where the preliminary feeding starts and a location where the transport operation starts, the first detection sensor detecting a trailing end of the previous medium while the second detection sensor detects the leading end of the subsequent medium if the preliminary feeding is determined to be completed based on whether a feeding motor is driving the preliminary feeding or whether the driver is no longer driving the preliminary feeding and the previous medium and the subsequent medium are both stopped, the determination value acquiring unit acquiring a determination value according to a gap between the trailing end of the previous medium and the leading end of the subsequent medium; and a control unit that performs the transport operation of the previous medium, wherein, if the determination value represents an appropriate gap between the previous medium and the subsequent medium, the control unit feeds the subsequent medium while the transport operation of the previous medium is being performed, and if the determination value represents an inappropriate gap, the control unit feeds no subsequent medium while the transport operation of the previous medium is being performed, and when it comes a time to acquire the determination value, if the preliminary feeding operation is still continuing, the control unit acquires no determination value and starts the transport operation of the previous medium.

* * * * *